US009164427B2

(12) United States Patent
Kobayashi

(10) Patent No.: US 9,164,427 B2
(45) Date of Patent: Oct. 20, 2015

(54) POWDER ACCOMMODATION CONTAINER AND IMAGE FORMING APPARATUS

(71) Applicant: FUJI XEROX CO., LTD., Tokyo (JP)

(72) Inventor: Akihiro Kobayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 92 days.

(21) Appl. No.: 13/724,866

(22) Filed: Dec. 21, 2012

(65) Prior Publication Data

US 2013/0322929 A1 Dec. 5, 2013

(30) Foreign Application Priority Data

May 29, 2012 (JP) ..... 2012-122251

(51) Int. Cl.
*G03G 15/08* (2006.01)

(52) U.S. Cl.
CPC ..... *G03G 15/0877* (2013.01); *G03G 15/0875* (2013.01); *G03G 15/0879* (2013.01); *G03G 15/0887* (2013.01); *G03G 15/0889* (2013.01); *G03G 15/0893* (2013.01)

(58) Field of Classification Search
CPC ..... G03G 15/0875; G03G 15/0879; G03G 15/0887; G03G 15/0889; G03G 15/0893
USPC ..... 399/263, 258, 260
See application file for complete search history.

(56) References Cited

U.S. PATENT DOCUMENTS

| | | | | |
|---|---|---|---|---|
| 6,385,422 | B1 * | 5/2002 | Ishiguro et al. | 399/258 |
| 2007/0258732 | A1 * | 11/2007 | Tanaka | 399/254 |
| 2007/0264051 | A1 * | 11/2007 | Tanaka | 399/254 |
| 2008/0279595 | A1 * | 11/2008 | Uezono | 399/263 |

FOREIGN PATENT DOCUMENTS

JP A-07-304281 11/1995

* cited by examiner

*Primary Examiner* — David Gray
*Assistant Examiner* — Tyler Hardman
(74) *Attorney, Agent, or Firm* — Oliff PLC

(57) ABSTRACT

A powder accommodation container includes an accommodation container body that accommodates powder, a transport member and a discharge port. The transport member is arranged in an inside of the accommodation container body, rotates about a rotating shaft, and transports powder in the inside of the accommodation container body. The discharge port is provided on the accommodation container body and discharges the powder accommodated in the accommodation container body to an outside of the accommodation container body. The transport member includes a first transport piece transporting the powder toward the discharge port at a position corresponding to the discharge port, and a second transport piece arranged on a downstream side in a rotating direction of the rotating shaft than the first transport piece. The second transport piece has a length that is in non-contact with the inner surface at an immediate downstream of the discharge port in the rotating direction.

18 Claims, 17 Drawing Sheets

POWDER ACCOMMODATION CONTAINER AND IMAGE FORMING APPARATUS

CROSS-REFERENCE TO RELATED APPLICATIONS

This application is based upon and claims priority under 35 USC 119 from Japanese Patent Application No. 2012-122251, filed May 29, 2012.

BACKGROUND

The present invention relates to a powder accommodation container and an image forming apparatus.

SUMMARY OF THE INVENTION (1) According to an aspect of the invention, a powder accommodation container includes:

an accommodation container body that accommodates powder;

a transport member that is arranged in an inside of the accommodation container body, rotates about a rotating shaft, and transports powder in the inside of the accommodation container body; and a discharge port that is provided on the accommodation container body and discharges the powder accommodated in the accommodation container body to an outside of the accommodation container body, wherein the transport member includes a first transport piece transporting the powder toward the discharge port at a position corresponding to the discharge port, and a second transport piece arranged on a downstream side in a rotating direction of the rotating shaft than the first transport piece, the second transport piece has a length that is in non-contact with the inner surface at an immediate downstream of the discharge port in the rotating direction, and the first transport piece becomes in contact with the inner surface at an immediate upstream of the discharge port in the rotating direction in a state where the second transport piece is in non-contact with the inner surface at the immediate downstream of the discharge port in the rotating direction.

(2) According to another aspect of the invention, a powder accommodation container includes:

an accommodation container body that accommodates powder;

a transport member that is arranged in an inside of the accommodation container body, rotates about a rotating shaft, and transports powder in the inside of the accommodation container body; and a discharge port that is provided on the accommodation container body and discharge the powder accommodated in the accommodation container body to an outside, wherein the transport member includes a first transport piece transporting the powder toward the discharge port at a position corresponds to the discharge port; and a second transport piece arranged on a downstream side in a rotating direction of the rotating shaft than the first transport piece, wherein the second transport piece passes through the position that corresponds to the discharge port prior to the first transport piece by rotation of the ritating shaft while a gap is formed between the first transport piece and the second transport piece in the rotating direction.

(3) In the powder accommodation container of (1) or (2), the width of the second transport piece in an axial direction of the rotating shaft is larger than a width of the discharge port in the axial direction.

(4) In the powder accommodation container of any one of (1) to (3), the width of the discharge port in the axial direction is larger than a width of the first transport piece in the axial direction, and the first transport piece is enterable in an inside of the discharge port.

(5) In the powder accommodation container of any one of (1) to (4), one end side of the second transport piece is fixed to the rotating shaft and the other side of the second transport piece is a free end, and a width of the free end side in the rotating direction is smaller than a width of the one end side in the axial direction.

(6) In the powder accommodation container of any one of (1) to (5), the first transport piece is provided in a first transport member of which one end side is fixed to the rotating shaft and the other end side is a free end that is in contact with the inner side of the accommodation container body, and the first transport member and the second transport piece use a fixing portion provided on the rotating shaft in common.

(7) On the powder accommodation container of any one of (1) to (6), the accommodation container body includes a second transport member which is rotated around a second rotating shaft to transport the powder in the inside of the accommodation container body toward the transport member, and The first transport piece is contactable with the second rotating shaft.

(8) In the powder accommodation container of any one of (1) to (7), the accommodation container body includes a second transport member which is rotated around a second rotating shaft to transport the powder in the inside of the accommodation container body toward the transport member, and the second transport member has one end side which is fixed to the rotating shaft and the other end side which is a free end that is contactable with the second transport piece.

(9) In the powder accommodation container of (7) or (8), the accommodation container body includes a hole formed to penetrate the inside and an outside of the accommodation container body, and a regulation member provided in the hole to regulate a passage of the powder through the hole. When the second transport member is in a position where the second transport member faces the hole, the second transport member becomes in non-contact with the inner surface of the powder accommodation container.

(10) In the powder accommodation container of any one of (1) to (9), the position where the free end of the second transport piece becomes in non-contact with the inner surface of the accommodation container body is confirmable from the outside of the powder accommodation container.

(11) According to another aspect of the invention, an image forming apparatus is an apparatus to which the powder accommodation container according to any one of claims 1 to 10 is detachable. The image forming apparatus forms an image using powder accommodated in the powder accommodation container.

With the configuration of (1), the discharge of the power from the powder accommodation container is performed more smoothly in comparison to the case that does not have the present configuration.

With the configuration of (2), the discharge of the power from the powder accommodation container is performed more smoothly in comparison to the case that does not have the present configuration.

With the configuration of (3), the powder can be removed in a larger range in comparison to the case that does not have the present configuration.

With the configuration of (4), the discharge of the power from the powder accommodation container is performed more smoothly in comparison to the case that the first transport piece does not come in the inside of the discharge port.

With the configuration of (5), the rigidity of the second transport piece is increased in comparison to the case that does not have the present configuration.

With the configuration of (6), is not necessary to establish the fixing portion with respect to the first transport member and the second transport member.

With the configuration of (7), the powder can be prevented from being attached to the first transport piece. With the configuration of (8), the powder can be prevented from being attached to the second transport piece.

With the configuration of (9), the hole can be prevented from being clogged up by the powder and the second transport can be prevented from being transformed.

With the configuration of (10), the stop position of the second transport piece can be determined to avoid the position in which the second transport is transformed.

With the configuration of (11), the image forming apparatus having the powder accommodation container from which the discharge of the power is performed more smoothly can be provided in comparison to the case that does not have the present configuration.

BRIEF DESCRIPTION OF THE DRAWINGS

Exemplary embodiments of the invention will be described in detail based on the following figures, wherein.

DETAILED DESCRIPTION

Hereinafter, embodiments of the present invention will be described in detail with reference to the accompanying drawings.

Figure 1:
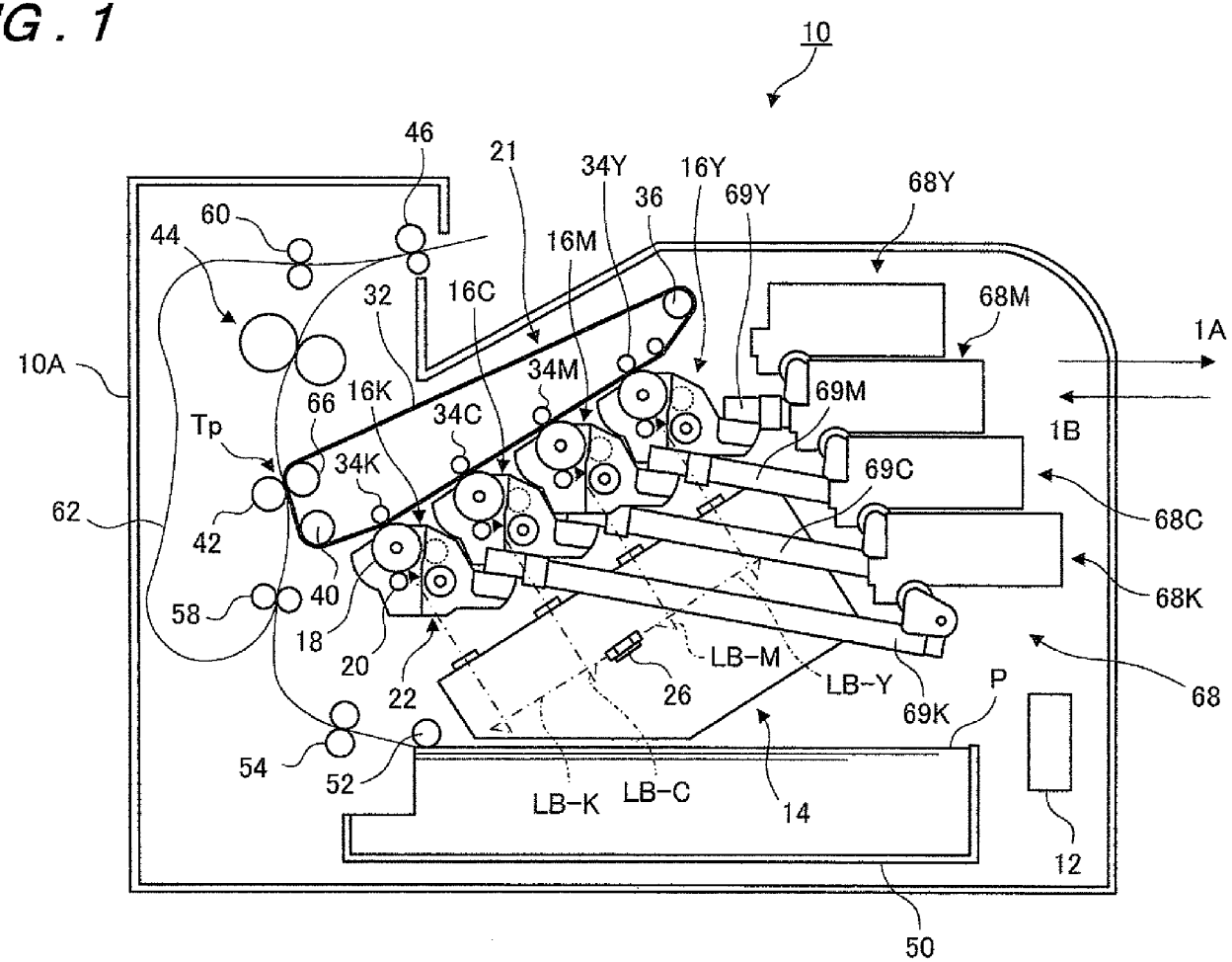
FIG. 1 is a view illustrating the overall configuration of an image forming apparatus according to an embodiment.

FIG. 1 is a view illustrating the overall configuration of an image forming apparatus 10 according to this embodiment. As shown in the drawing, the image forming apparatus 10 according to this embodiment includes an image processing unit 12 provided inside an apparatus body 10A to perform a predetermined image process with respect to received image data. Further, the image forming apparatus 10 according to this embodiment includes an exposure device 14 provided to receive the image data from the image processing unit 12 and to perform exposure by laser beams LB.

Further, on an upper side of the exposure device 14, four image forming units 16Y, 16M, 16C, and 16K forming toner images of yellow (Y), magenta (M), cyan (C), and black (K). Here, the four image forming units 16Y, 16M, 16C, and 16K, which function as parts of an image forming unit, are arranged to line up in a slant direction with respect to the horizontal direction. Further, the four image forming units 16Y, 16M, 16C, and 16K are detachably provided on the apparatus body 10A.

Each of the image forming units 16Y, 16M, 16C, and 16K includes a cylindrical photosensitive drum 18 rotating at a predetermined speed, a charging member 20 charging a circumferential surface of the photosensitive drum 18, a developing device 22 developing an electrostatic latent image formed on the photosensitive drum 18 through exposure by an exposure device 14 using toner as an example of the powder, and a drum cleaner (not illustrated) contacting the photosensitive drum 18 to remove the toner and the like attached to the photosensitive drum 18. Further, the image forming apparatus 10 according to this embodiment includes a toner supply device 68 supplying the toner to the developing device 22 provided in each of the image forming units 16Y, 16M, 16C, and 16K.

Here, the toner supply device 68 has four toner cartridges 68Y, 68M, 68C, and 68K that accommodate yellow, magenta, cyan, and black toners, respectively. Further, the toner supply device 68 has a first transport pipe 69Y, a second transport pipe 69M, a third transport pipe 69C, and a fourth transport pipe 69K that transport the toners accommodated in the toner cartridges 68Y, 68M, 68C, and 68K to the corresponding developing device 22.

On the other hand, in this embodiment, the four toner cartridges 68Y, 68M, 68C, and 68K can be taken off from the apparatus body 10A by moving them in a direction indicated by an arrow 1A in the drawing. Further, the four toner cartridges 68Y, 68M, 68C, and 68K can be mounted in the apparatus body 10A by moving them in a direction indicated by an arrow 1B. On the other hand, an opening and closing covers (not illustrated) are provided on the apparatus body 10A, and this opening and closing covers are opened when the toner cartridges 68Y, 68M, 68C, and 68K are taken off or mounted.

The exposure device 14 has four semiconductor lasers (not illustrated), and laser beams LB-Y, LB-M, LB-C, and LB-K are emitted from the semiconductor lasers according to image data. On the other hand, the laser beams LB-Y, LB-M, LB-C, and LB-K emitted from the semiconductor lasers are emitted to a polygon mirror 26 through a cylindrical lens, and are deflection scanned by the polygon mirror 26. The laser beams LB-Y, LB-M, LB-C, and LB-K deflection scanned by the polygon mirror 26 are slantingly input from a lower side to exposure points on the photosensitive drum 18 through an image forming lens (not illustrated) and a plurality of mirrors.

Further, according to this embodiment, a transfer unit 21 is provided on an upper side of the image forming units 16Y, 16M, 16C, and 16K. This transfer unit 21 includes an intermediate transfer belt 32 endlessly formed to circulate along a predetermined path, a drive roll 36 arranged in the inside of the intermediate transfer belt 32 to rotate the intermediate transfer belt 32 in a clockwise direction as shown in the drawing, a tension grant roll 40 pushed from the inside of the intermediate transfer belt 32 to the intermediate transfer belt 32 to grant a tension to the intermediate transfer belt 32, and a driven roll 65 arranged on an upper side than the tension grant roll 40 as shown in the drawing to be rotated by a driving force received from the intermediate transfer belt 32. Further, in this embodiment, a belt cleaner (not illustrated) is provided to remove the toner and the like attached to the intermediate transfer belt 32.

Further, the transfer unit 21 includes primary transfer rolls 34Y, 34M, 34C, and 34K arranged to face the photosensitive drums 18, respectively, on the inside of the intermediate transfer belt 32. Here, each of the first transfer rolls 34Y, 34M, 34C, and 34K transfers a toner image on the photosensitive drum 18 provided in each of the image forming units 16Y, 16M, 16C, and 16K to the intermediate transfer belt 32. Through this, on the intermediate transfer belt 32, a toner image in which four toner images of a yellow toner image, a magenta toner image, a cyan toner image, and a black toner image overlap one another is formed.

Further, in this embodiment, a secondary transfer roll 42 is provided in an opposite position of the driven roll 66 while the intermediate transfer belt 32 is interposed between them. The toner image formed on the intermediate transfer belt 32 is transported up to a region where the second transfer roll 42 is provided by the intermediate transfer belt 32. Then, the toner image is transferred onto a sheet being transported by a secondary transfer portion Tp where the secondary transfer roll 42 and the driven roll 66 are in press contact with each other. Further, in this embodiment, on the downstream side in a transport direction of the sheet P than the secondary transfer portion Tp, a fixing device 44 that fixes the toner image transferred to the sheet P onto the sheet P using heat and pressure is provided. Further, on the downstream side of the fusing device 44, a discharge roll 46 discharging the sheet P of which the fixing process has been completed to an upper portion of the apparatus body 10A is provided.

Further, in this embodiment, a sheet accommodation portion 50 accommodating a plurality of sheets P, a delivery roll 52 that is in contact with the uppermost one of the sheets P accommodated in the sheet accommodation portion 50 to deliver the sheet P, and a transport roll 54 separating the sheets P delivered by the delivery roll 52 one by one and transporting the separated sheets P are provided. Further, on the downstream side of the transport roll 54, a transport roll 58 that further transports the sheet P toward the secondary transfer portion Tp is provided. Further, in this embodiment, a transport roll 60 is provided to transport the sheet P having one surface, to which the toner image has been fixed, to a transport path 62 for both-sided printing. Here, the sheet P sent to the transport path 62 for both-sided printing is supplied again to the secondary transfer portion Tp in a state where both sides thereof have been reversed. Through this, images are formed on both sides of the sheet P Here, when the image forming is performed by the image forming apparatus 10 according to this embodiment, for example, image data acquired by a manuscript scanning device (not illustrated) or image data formed by a PC (not illustrated) is input to the image processing unit 12 as 8-bit data of red (R), green (G), and blue (B), respectively. The image processing unit 12 performs predetermined image processing, such as shading correction, position gap correction, brightness/color space conversion, gamma correction, border erase or color edition, and movement edition, with respect to the input data. The image data of which the image processing has been performed is converted into gradation data of four colors of yellow, magenta, cyan, and black to be output to the exposure device 14.

As described above, the exposure device 14 has four semiconductor lasers, and laser beams LB-Y, LB-M, LB-C, and LB-K are emitted from the semiconductor lasers according to gradation data. On the other hand, the laser beams LB-Y, LB-M, LB-C, and LB-K emitted from the semiconductor lasers are emitted to the polygon mirror 26 through the cylindrical lens, and are deflection scanned by the polygon mirror 26. The laser beams LB-Y, LB-M, LB-C, and LB-K deflection scanned by the polygon mirror 26 are input to the photosensitive drum 18.

Through this, the surface of the photosensitive drum 18 is scanning exposed, and an electrostatic latent image is formed thereon. The formed electrostatic latent image is developed as toner images of respective colors of yellow, magenta, cyan, and black by the developing devices 22 provided in the respective image forming units 16Y, 16M, 16C, and 16K. Further, the toner images formed on the photosensitive drums 18 of the image forming units 16Y, 16M, 16C, and 16K are transferred onto the intermediate transfer belt 32 by the primary transfer rolls 34Y, 34M, 34C, and 34K.

On the other hand, in a sheet transport system transporting the sheet P, the delivery roll 52 is rotated, and the sheet P is delivered from the sheet accommodation portion 50. Further, the sheets P separated one by one by the transport roll 54 are transported up to the transport roll 58 and then are stopped. Thereafter, the transport roll 58 is rotated to match the movement timing of the intermediate transfer belt 32 on which the toner image is formed, and the sheet P is transported to the secondary transport portion Tp that is formed by the driven roll 66 and the secondary transfer roll 42.

Further, in the secondary transfer portion Tp, the toner images formed on the intermediate transfer belt 32 are sequentially transferred onto the sheet P by the contact pressure and an electric field formed by the secondary transfer portion Tp. Thereafter, the sheet P onto which the toner images have been transferred is fixed by the fixing device 44, and then is discharged to the upper portion of the apparatus body 10A by the discharge roll 46. On the other hand, in the case of forming images on both sides of the sheet P, the sheet P is transported again to the secondary transfer portion Tp through sending of the sheet P to the transport path 62 for both-sided printing, and an image is formed on the other side surface of the sheet P.

Here, the toner cartridges 68Y, 68M, 68C, and 68K provided in the toner supply device 68 will be described in detail.

Figure 2:
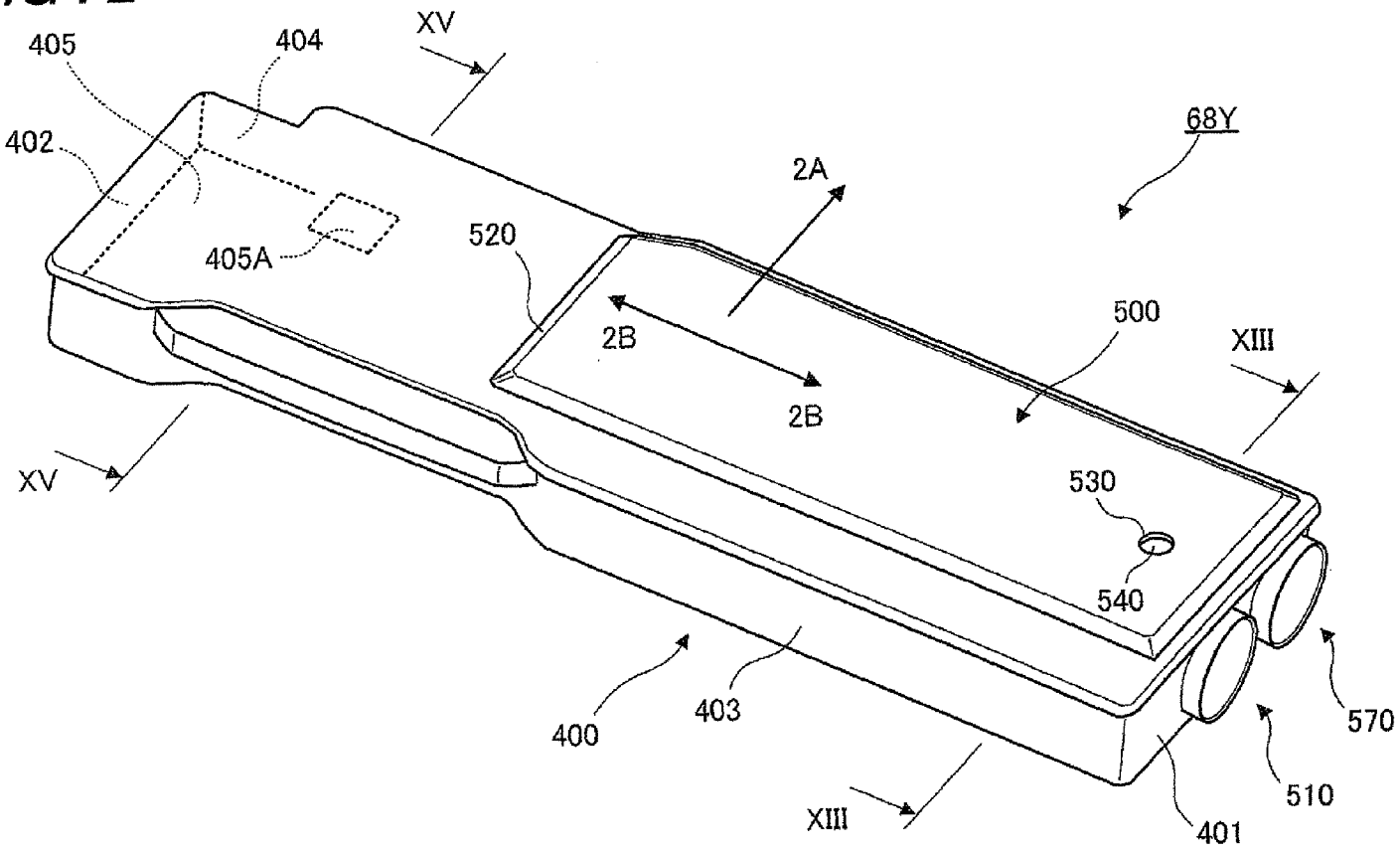
FIG. 2 is a perspective view of a toner cartridge accommodating yellow toner as seen from an upper side.

FIG. 2 is a perspective view of a toner cartridge 68Y accommodating yellow toner as seen from an upper side. On the other hand, since the toner cartridges 68M, 68C, and 68K are configured in the same manner as the toner cartridge 68Y, the description of the toner cartridges 68M, 68C, and 68K will be omitted.

As shown in the drawing, the toner cartridge 68Y as an example of a powder accommodation container is formed in a rectangular parallelepiped shape. Further, when the toner cartridge 68Y is mounted in the apparatus body 10A, the toner cartridge 68Y is pressed in the direction indicated by an arrow 2A as shown in the drawing to be mounted in the apparatus body 10A. Further, the toner cartridge 68Y according to this embodiment is extended in a direction (direction indicated by an arrow 2B in the drawing) that is orthogonal to the fixing direction (direction indicated by an arrow 2A in the drawing) when the toner cartridge 68Y is mounted in the apparatus body 10A and is in an elongated shape.

Further, in the toner cartridge 68Y, an accommodation container body (cartridge body) composed of a toner accommodation portion 400 and a cover member 500 is provided. Here, the toner accommodation portion 400 is formed in a box shape and has a rectangular opening formed on an upper portion thereof. Further, the cover member 500 is attached to the upper portion of the toner accommodation portion 400, is formed in a rectangular shape, and blocks up the opening formed on the upper portion of the toner accommodation portion 400. On the other hand, the accommodation of the toner in the inside of the toner cartridge 68Y is performed by supplying the toner into the inside of the toner cartridge 68Y through an opening 510 provided on a side surface of the toner cartridge 68Y.

In other words, after the cover member 500 is mounted on the toner accommodation portion 400, the toner is supplied through the opening 510, and the toner is accommodated in the toner cartridge 68Y. Here, after the supply of the toner to the inside of the toner cartridge 68Y is completed, the opening 510 is blocked up. On the other hand, one more opening 570 are provided on the side of the opening 510. When the toner is supplied into the toner cartridge 68Y through the opening 510, air inside the toner cartridge 68Y is discharged through the opening 570. On the other hand, the opening 570 is also blocked up after the supply of the toner into the toner cartridge 68Y is completed.

The toner accommodation portion 400 includes a first side wall 401 arranged along the mounting direction (direction indicated by an arrow 2A) when the toner cartridge 68Y is mounted in the apparatus body 10A, a second side wall 402 arranged in an opposite position of the first side wall 401, a third side wall 403 arranged to be orthogonal to the first side wall 401, and a fourth side wall 404 arranged in an opposite position of the third side wall 403. Further, the toner accommodation unit 400 includes a bottom plate 405 which is formed in a rectangular shape and is connected to lower end portions of the first to fourth side walls 401 to 404. Here, on the bottom plate 405, a toner discharge port 405A that is formed in a rectangular shape and is used to discharge the toner is formed. On the other hand, the first to fourth side walls 401 to 404 and the bottom plate 405 are integrally formed to constitute the toner accommodation portion 400.

On the other hand, the cover member 500 is also formed in a rectangular shape as described above. Further, the cover member 500 has a through-hole 530 formed thereon to function as a hole portion for introducing external air of the toner cartridge 68Y into the inside. Here, if the toner inside the toner cartridge 68Y is discharged, the internal pressure of the toner cartridge 68Y decreases, and thus it becomes difficult to discharge the toner. In this embodiment, air is supplied into the toner cartridge 68Y through a through-hole 530 to facilitate the discharge of the toner.

Further, in this embodiment, in order to prevent the toner from leaking from the through-hole 530, a filter 540 as an example of a regulator member that passes air but regulates the passing of the toner is provided in the inside than the through-hole 530. Here, the filter 540 is formed by nonwoven fabric, textile, or knitting. On the other hand, the material of the filter 540 is not specially limited, and natural fiber or chemical fiber may be used as the material of the filter 540.

Figure 3:
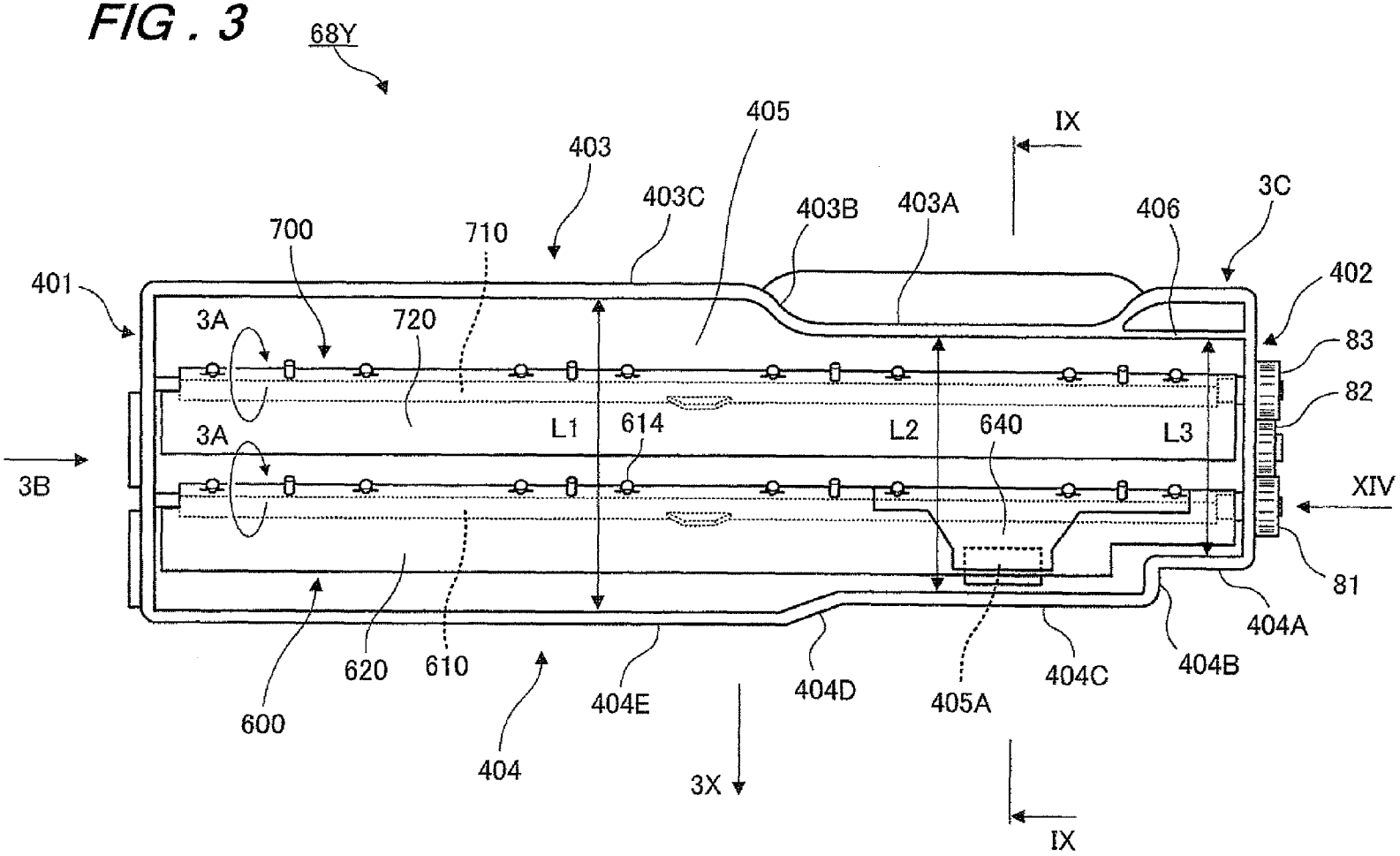
FIG. 3 is a view illustrating a toner cartridge from which a cover member has been taken off.

FIG. 3 is a view illustrating a toner cartridge 68Y from which a cover member 500 has been taken off. FIG. 3 is a view of a toner accommodation portion 400 as seen from an upper side. On the other hand, in FIG. 3, the mounting direction when the toner cartridge 68Y is mounted in the apparatus body 10A is indicated by an arrow 3X.

As described above, the toner accommodation portion 400 is formed in a box shape and has first to fourth side walls 401 to 404 provided on side wall regions. Further, the toner accommodation portion 400 includes a bottom plate 405 on the lower side than the first to fourth side walls 401 to 404. Here, on the bottom plate 405, as described above, the toner discharge port 405A that is formed in a rectangular shape and is used to discharge the toner is formed. On the other hand, the toner discharge port 405A is provided on the side of the second side wall 402 than the center portion in the length direction of the toner accommodation portion 400. Further, the toner discharge port 405A is provided in a region where the bottom plate 405 and the fourth side wall 404 cross each other.

Although the description has been omitted as described above, in the inside of the toner accommodation portion 400, a first transport member 600 is provided which is arranged along the length direction of the toner accommodation portion 400 and is provided on the side of the fourth side wall 404 to transport the toner in the toner accommodation portion 400 toward the toner discharge port 405A while stirring the toner. Further, in the inside of the toner accommodation portion 400, a second transport member 700 is provided which is arranged along the length direction of the toner accommodation portion 400 and is provided on the side of the third side wall 403 to transport the toner in the toner accommodation portion 400 toward the first transport member 600.

Further in this embodiment, on the outer surface of the second side wall 402, a disk-shaped first gear 81 is provided which is tooth-engaged with a gear (not shown) provided on the side of the apparatus body 10A, and receives a driving force from the transmission gear 910 to be rotated. Further, on the outer surface of the second side wall 402, a disk-shaped second gear 82 is provided which is tooth-engaged with the first gear 81 and receives a driving force from the first gear 81 to be rotated.

Further, on the outer surface of the second side wall 402, a third gear 83 is provided which is disk-shaped, is tooth-engaged with the second gear 82, and receives a driving force from the transmission gear 910 to be rotated. Here, if the first gear 81 receives the driving force and is rotated, the second gear 82 is rotated in an opposite direction to the rotating direction of the first gear 81. Further, if the first gear 81 receives the driving force and is rotated, the third gear 83 is rotated in the same direction as the rotating direction of the first gear 81.

Here, as an example of a powder transport member, a first transport member 600 includes a rotating shaft 610 arranged along a length direction of a toner accommodation portion 400 to be rotated, a first sheet member 620 formed of a resin material such as PET in a thin plate shape and attached to the rotating shaft 610, and a second sheet member 640 formed of a resin material in a thin plate shape and attached to the rotating shaft 610 in the same manner.

Here, the first sheet member 620 moves toner accommodated in the toner accommodation portion 400 toward a toner discharge port 405A along the shaft direction of the rotating shaft 610. Further, the second sheet member 640 moves the toner toward the toner discharge port 405A along the direction that is orthogonal to the shaft direction of the rotating shaft 610. On the other hand, the rotating shaft 610 is connected to the first gear 81, and receives a driving force from the first gear 81 to be rotated.

Further, as an example of a second powder transport member, a second transport member 700 is configured in the same manner as the first transport member 500, and includes a rotating shaft 710 arranged along the length direction of the toner accommodation portion 400 to be rotated and a sheet member 720 formed of a resin material such as PET in a thin plate shape and attached to the rotating shaft 710. Here, the second transport member 700 uses the sheet member 720 as an example of an elastic piece, and pushes the toner that is accommodated in the toner accommodation portion 400 toward the first transport member 600.

On the other hand, the rotating shaft 710 of the second transport member 700 is connected to a third gear 83, and receives a driving force from the third gear 83 to be rotated. Here, in this embodiment, since the third gear 83 and the first gear 81 that is used for the rotation of the first transport member 600 are connected to each other through a second gear 82, the first transport member 600 and the second transport member 700 interlock with each other On the other hand, when the toner is transported by the first transport member 600 and the second transport member 700, the first transport member 600 and the second transport member 700 are rotated in the direction indicated by an arrow 3A in the drawing. In other words, in the case of seeing the toner accommodation portion 400 from the direction indicated by an arrow 3B in the drawing, the first transport member 600 and the second transport member 700 are rotated in the counterclockwise direction.

Then, a third side wall 403 and a fourth side wall 404 provided in the toner accommodation portion 400 will be described. As shown in FIG. 3, the third side wall 403 includes a first region 403A positioned on the side of the second side wall 402, a second region 403B connected to the first region 403A and positioned on the side of the first side wall 401 than the first region 403A, and a third region 403C connected to the second region 403B and positioned on the side of the first side wall 401 than the second region 403B Here, the first region 403A is arranged along the length direction of the toner accommodation portion 400 and is provided on the side close to the fourth side wall 404 than the third region 403C. Further, the second region 403B is slantingly arranged with respect to the length direction of the toner accommodation portion 400, and moves from the side where the first side wall 401 is provided to the side where the second side wall 402 is provided to approach the side of the fourth side wall 404. Further, the third region 403C is arranged along the length direction of the toner accommodation portion 400 and is connected to the first side wall 401.

On the other hand, the fourth side wall 404 is configured by five regions of the first to fifth regions 404A to 404E. Here, the first region 404A is arranged along the length direction of the toner accommodation portion 400 and is connected to the second side wall 402.

Further, the second region 404B is connected to the end portion of the first region 404A (end portion on the side of the first side wall 401) and is arranged to be orthogonal to the first region 404A. Further, the second region 404B is provided on the side that is apart from the third side wall 403 than the first region 404A. Further, the third region 404C is connected to the second region 404B and is prepared on the side of the first side wall 401 than the second region 404B. Further, the third region 404C is provided on the side that is apart from the third side wall 403 than the second region 404B.

Further, the fourth region 404D is connected to the third region 404C and is provided on the side of the first side wall 401 than the third region 404C. Further, the fourth region 404D is provided on the side that is apart from the third side wall 403 than the third region 404C. Further, the fourth region 404D is slantingly arranged with respect to the length direction of the toner accommodation portion 400, and moves from the side where the first side wall 401 is provided to the side where the second side wall 402 is provided to approach the side of the third side wall 403.

Further, the fifth region 404E is connected to the fourth region 404D, and is provided on the side of the first side wall 401 than the fourth region 404D. Further, the fifth region 404E is provided on the side that is apart from the third side wall 403 than the fourth region 404D.

Here, in this embodiment, as a result of forming the third side wall 403 and the fourth side wall 404 as described above, dimensions in the width direction of the toner accommodation portion 400 (width dimensions, dimensions in the direction that is orthogonal to the length direction) differ in the length direction of the toner accommodation portion 400. More specifically, the dimensions in the width direction of the toner accommodation portion 400 becomes smaller progressively as the toner accommodation portion 400 is directed from the side where the first side wall 401 is positioned to the side where the second side wall 402 is positioned. More specifically, according to this embodiment, since the dimensions in the width direction of the toner accommodation portion 400 differ, the cross section of the toner accommodation portion 400 (toner cartridge 68Y) becomes smaller progressively as the toner accommodation portion 400 is directed from the side where the first side wall 401 is positioned to the side where the second side wall 402 is positioned.

More specifically, in a portion where the third region 403C of the third side wall 403 and the fifth region 404E of the fourth side wall 404 face each other, the dimensions in the width direction of the toner accommodation portion 400 have become dimensions L1. On the other hand, in a portion where the first region 403A of the third side wall 403 and the third region 404C of the fourth side wall 404 face each other, the dimensions in the width direction of the toner accommodation portion 400 have become dimensions L2 that are smaller than the dimensions L1. Further, in a portion where the first region 403A of the third side wall 403 and the first region 404A of the fourth side wall 404 face each other, the dimensions in the width direction of the toner accommodation portion 400 have become dimensions L3 that are smaller than the dimensions L2.

As shown as a reference numeral 3C in FIG. 3, the first region 403A of the third side wall 403 projects from the end portion in the length direction of the toner accommodation portion 400 to the outside, and thus the distance between the first region 403A of the third side wall 403 and the first region 404A of the fourth side wall 404 increases at the end portion of the toner accommodation portion 400. However, a partition 406 is provided on the inside of the first region 403A of the third side wall 403, and thus the actual dimensions of the toner accommodation portion 400 in the portion where the first region 403A of the third side wall 403 and the first region 404A of the fourth side wall 404 face each other, as described above, have become dimensions L3 that are smaller than the dimensions L2.

Figure 4:
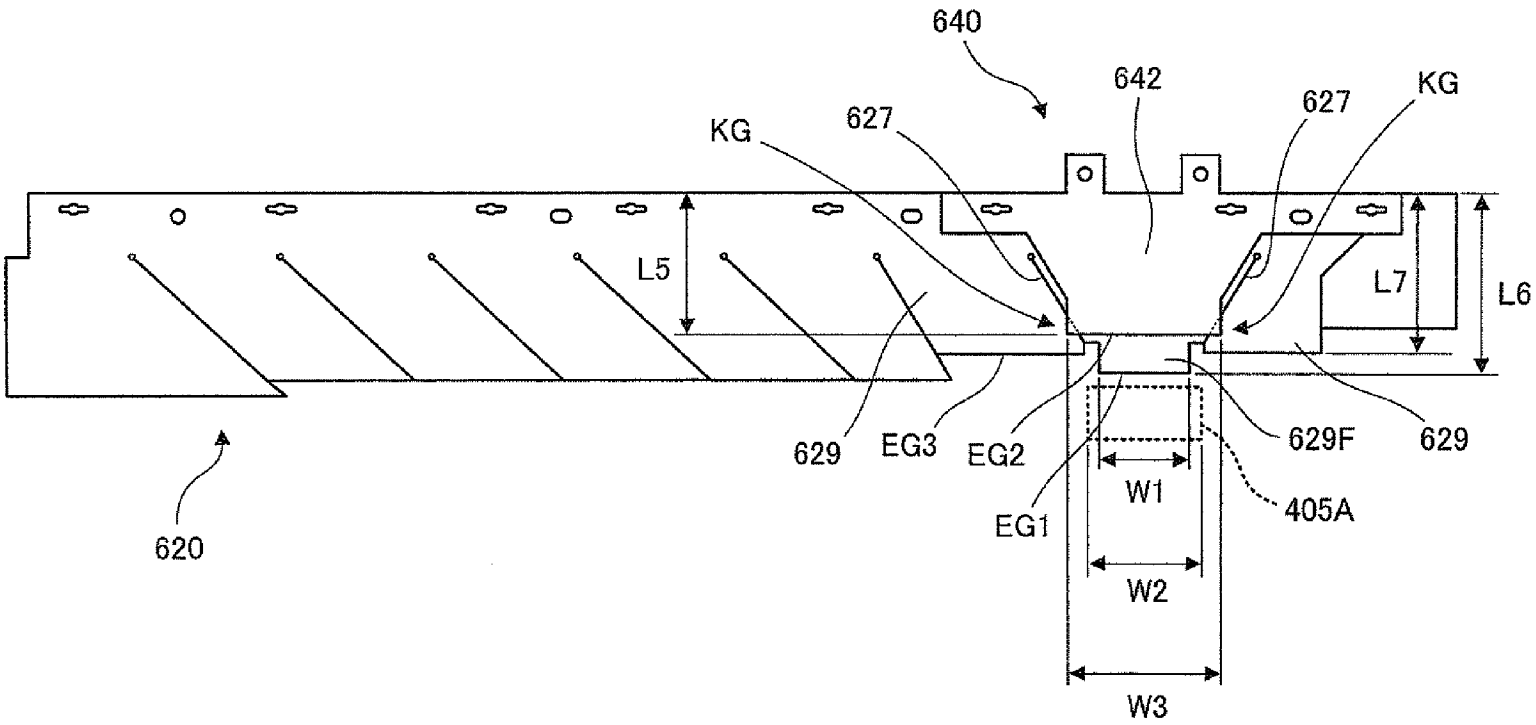
FIG. 4 is a front view of a first sheet member and a second sheet member provided on a first transport member.

FIG. 4 is a front view of a first sheet member 620 and a second sheet member 640 provided on the first transport member 600. On the other hand, in order to explain the position relationship between the first sheet member 620, the second sheet member 640, and the toner discharge port 405A, the toner discharge port 405A is also illustrated in FIG. 4.

In this embodiment, as illustrated in the drawing, the first sheet member 620 is formed in a rectangular shape and also in a belt shape.

Further, in this embodiment, the second sheet member 640 overlaps the first sheet member 620 that is formed in the rectangular shape and also in the belt shape.

Figure 5:
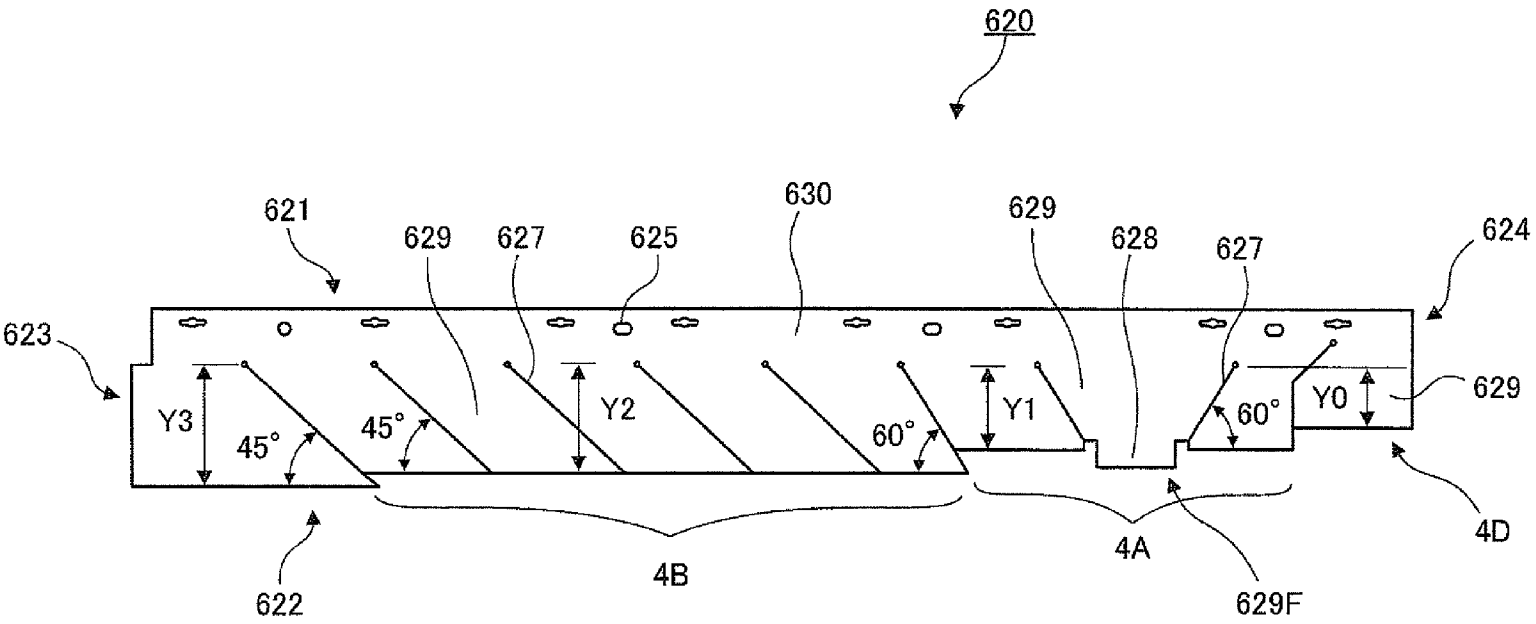
FIG. 5 is a view illustrating a state where the second sheet member is taken off from the state of FIG. 4.

FIG. 5 is a view illustrating a state where the second sheet member 640 is taken off from the state of FIG. 4. Using this drawing, the first sheet member 620 will be described in detail.

The first sheet member 620 is formed of a resin material, and has flexibility (elasticity). Further, the sheet member 620 is in a thin plate shape. Further, the first sheet member 620 is in a rectangular (belt) shape, and has first to fourth side cut portions 621 to 624 provided on the circumference of the first sheet member 620.

Here, the first sheet member 620 is arranged so that the first and second side cut portions 621 and 622 go along the length direction of the toner accommodation portion 400. Further, the sheet member 620 is arranged so that the length direction of the first sheet member 620 goes along the rotating shaft 610 (see FIG. 3), and the side of the first side cut portion 621 that is positioned at one end portion in the width direction of the first sheet member 620 is attached to the rotating shaft 610. That is, the first sheet member 620 is attached to the rotating shaft 610 so that the side of the second side cut portion 622 that is positioned at the other end portion in the width direction of the first sheet member 620 has become a free end.

Further, in this embodiment, the first sheet member 620 is arranged so that the third side cut portion 623 is positioned on the side of the first side wall 401 (see FIG. 3) of the toner accommodation portion 400, and the first sheet member 620 is arranged so that the fourth side cut portion 624 is positioned on the side of the second side wall 402 of the toner accommodation portion 400.

Further, in this embodiment, a plurality of through-holes 625 are formed in an area which is adjacent to the first side cut portion 621 of the first sheet member 620 and is in a belt shape that goes along the first side cut portion 621.

In this embodiment, projections 614 (see FIG. 3) provided on the rotating shaft 610 are inserted into the through-holes 625 to fix the first sheet member 620 to the rotating shaft 610. On the other hand, the fixing of the first sheet member 620 to the rotating shaft 610 may be performed, for example, using a fastening member such as a screw or by adhesion and the like.

Further, on the first sheet member 620, a plurality of slits 627, which start from the second side cut portion 622 toward the side of the first side cut portion 621, are formed. Further, in this embodiment, since the plurality of slits 627 are provided, the first sheet member 620 has flexible (elastically transformed) pieces 629 provided between the adjacent slits 627. The flexible pieces 629 has a free end that is the side of the second side cut portion 622 and a fixed end that is the side of the first side cut portion 621 and is flexed (elastically transformed).

On the other hand, a plurality of flexible pieces 629 are provided. Here, the flexible piece 629 is a region that is positioned on the side of the first side cut portion 621 of the first sheet member 620, and is supported by a rectangular-shaped (belt-shaped) region (hereinafter referred to as a "base portion 630") arranged to go along the first side cut portion 621.

Here, in this embodiment, one of the plurality of flexible pieces 629 (flexible piece 629 indicated by a reference numeral 629F in FIG. 5) is arranged in a facing position to the toner discharge port 405A (see FIG. 3). Further, one flexible piece 629 (hereinafter referred to as a "facing flexible piece 629F") that functions as a pushing piece pushes out the toner toward the toner discharge port 405A when the rotating shaft 610 is rotated. On the other hand, at a front end of the facing flexible piece 629, a projection portion 628 which projects toward the direction that is separated from the facing flexible piece 629 is formed.

On the other hand, in this embodiment, the slits 627 are slantingly arranged with respect to the rotating shaft 610, and the slit 627 that is positioned on the side of the third side cut portion 623 than the opposite bent piece 629F is directed from the second side cut portion 622 to the first side cut portion 621 to approach the side of the third side cut portion 623. Further, the slit 627 that is positioned on the side of the fourth side cut portion 624 than the opposite bent piece 629F is directed from the second side cut portion 622 to the first side cut portion 621 to approach the side of the fourth side cut portion 624. More specifically, in this embodiment, the slits 627 are slantingly formed to be directed from the second side cut portion 622 as a start point toward the side of the first side cut portion 621, and further to be directed toward the upstream side in the transport direction of the toner through the first transport member 600 (see FIG. 3).

Further, in this embodiment, the lengths of the bent pieces 629 differ depending on the regions where the bent pieces 629 are arranged. Specifically, the length of three bent pieces 629 (three bent pieces 629 indicated by reference numeral 4A in FIG. 5) arranged on the opposite region of the third region 404C of the fourth side wall 404 (see FIG. 3) of the plurality of bent pieces 629 is set to dimensions Y1. On the other hand, the length of five bent pieces 629 (five bent pieces 629 indicated by reference numeral 4B in FIG. 5) arranged on the opposite region of the fourth and fifth regions 404D and 404E of the fourth side wall 404 of the bent pieces 629 is set to dimensions Y2 that are larger than the dimensions Y1.

Here, in this embodiment, if the fourth and fifth regions 404D and 404E of the fourth side wall 404 are positioned on the side that is apart from the third side wall 403 than the third region 404C, and the lengths of all the bent pieces 629 are the same, it becomes difficult to transport the toner that is positioned on the opposite region of the fourth and fifth regions 404D and 404E. Because of this, in this embodiment, as described above, the length of the five bent pieces 629 arranged on the opposite region of the fourth and fifth regions 404D and 404E is set to be larger than the length of the three bent pieces 629.

On the other hand, in this embodiment, one of the bent pieces 629 that is positioned on the left side than the five bent pieces 629 in the drawing has the length of dimensions Y3 that are larger than dimensions Y2. Through this, in this embodiment, the toner that may be delayed in the corner portion of the toner accommodation portion 400 is scraped out. Further, in this embodiment, one of the bent pieces 629 (one bent piece 629 indicated by reference numeral 4D in FIG. 5) arranged on the opposite region to the first region 404A of the fourth side wall 404 has the length of dimensions Y0 that are smaller than dimensions Y1.

Further, in this embodiment, the angles of the plurality of slits 627 with respect to the second side cut portion 622 differ depending on the positions in which the slits 627 are provided.

Specifically, the angle of two slits 627 that are positioned on the left and right of the one of the three bent pieces 629

(three bent pieces 629 indicated by reference numeral 4A) that is positioned in the center in the drawing is set to 60°. Further, the angle of the slit 627 that is positioned between the bent piece 629 (facing flexible piece 629F) that is positioned on the leftmost side of the three bent pieces 629 in the drawing and the bent piece 629 that is positioned on the rightmost side of the five bent pieces 629 in the drawing is set to 60°.

On the other hand, the angle of the four silts 627 formed in order to form the five bent pieces 629 with respect to the second side cut portion 622 is set to 45°. Further, the slit 627 that is positioned between the bent piece 629 positioned at the left end of the five bent pieces 629 and one bent piece 629 positioned on the left side of the bent piece 629 is formed at 45°.

Figure 6:
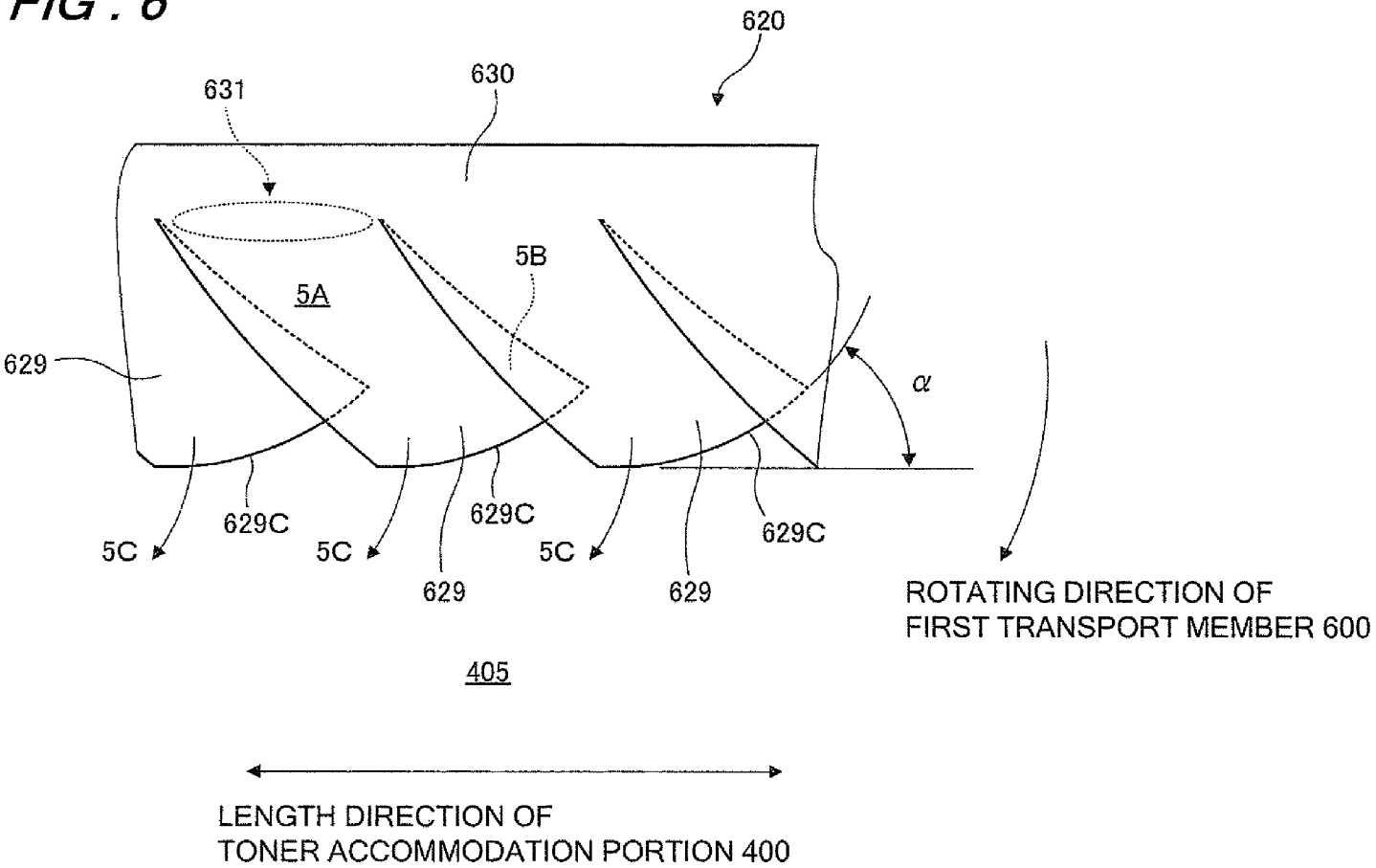
FIG. 6 is a view explaining the movement of a flexible piece.

Here, referring to FIG. 6 (drawing for explaining the movement of the bent piece 629), the movement of the bent piece 629 when the toner is transported will be described. On the other hand, FIG. 6 illustrates the state of the bent piece 629 when the free end side of the bent piece 629 is positioned on the lower side and the toner on the bottom plate 405 is pushed out to the side of the fourth side wall 404 (see FIG. 3). Further, FIG. 6 illustrates three bent pieces 629 included in the five bent pieces 629. On the other hand, in FIG. 6, the illustration of the toner is omitted.

In this embodiment, since the slits 627 are slantingly arranged as described above, the rigidity of the bent piece 629 differs in each region of the bent piece 629. Specifically, since the region that is positioned on the lower side of a connection portion 631 between the base portion 630 and the bent piece 629, of the bent pieces 629 and is supported by the connection portion 631 (region indicated by reference numeral 5A, hereinafter referred to as a "supported region 5A") is close to the base portion 630, it has high rigidity and is difficult to be deformed. On the other hand, the region that is apart from the lower side of the connection portion 631 (region indicated by reference numeral 5B, hereinafter referred to as an "outside region 5B") is apart from the base portion 630, and thus it is liable to be deformed.

As a result, since the outside region 5B is liable to be deformed when the bent piece 629 pushes out the toner, the outside region 5B is bent greater than the region 5A to be supported. Further, in this case, as shown in FIG. 6, a front edge 629C that is positioned on the free end side of the bent piece 629 is slanted with respect to the length direction of the toner accommodation unit 400.

That is, when the bent piece 629 pushes out the toner, the front edge 629C of the bent piece 629 is slanted so that the side of the bent piece 629 that is close to the toner discharge port 405A is positioned on the upstream side in the rotating direction of the first transport member 600 and the side of the bent piece 629 that is apart from the toner discharge port 405A is positioned on the downstream side in the rotating direction. In this case, the toner is pushed out in the direction (the downstream side in the rotating direction of the first transport member 600) indicated by an arrow 5C in the drawing, and is pushed out toward the toner discharge port 405A.

On the other hand, in FIG. 6, the state of the bent piece 629F that is positioned on the side of the third side cut portion 623 than the opposite bent piece 629F is illustrated. However, event in the case of the bent piece 629 that is positioned on the side of the fourth side cut portion 624 (see FIG. 5) than the opposite bent piece 629, during the transport of the toner, as described above, the front edge 629C is slanted. Specifically, the front edge 629C of the bent piece 629 is slanted so that the side that is close to the tone discharge port 405A is positioned on the upstream side in the rotating direction of the first transport member 600 and the side that is apart from the toner discharge port 405A is positioned on the downstream side in the rotating direction. Through this, even the toner that is positioned on the side of the fourth side cut portion 624 than the opposite bent piece 629 is moved toward the toner discharge port 405A.

Then, with reference to FIG. 7 (drawing to explain the second sheet member 640), the second sheet member 640 will be described in detail.

The second sheet member 640 is formed of a resin material, and has flexibility (elasticity) in the same manner as the first sheet member 620. Further, the sheet member 640 is in a thin plate shape.

Here, the second sheet member 640 is in a rectangular shape, and has a fixing portion 641 that is fixed to the rotating shaft 610 (see FIG. 3). Here, a plurality of through-holes 641A are formed on the fixing portion 641. Further, in this embodiment, the fixing of the fixing portion 641 to the rotating shaft 610 may be performed, for example, using a fastening member such as a screw or by adhesion and the like. Further, in this embodiment, the first sheet member 620 and the second sheet member 640 are fixed by using the projection 614 in common.

Further, the fixing portion 641 has a first long side 641B and a second long side 641C arranged along the shaft direction of the rotating shaft 610. Further, the fixing portion 641 has a first short side 641D at one end portion in the length direction of the fixing portion 641, and a second short side 641E at the other end in the length direction of the fixing portion 641.

Further, on the second sheet member 640, a projection piece 642 that projects from the second long side 641C of the fixing portion 641 is provided. Here, the projection piece 642 that is an example of an elastic piece is provided to be extended in the direction that is orthogonal to the length direction of the fixing unit 641. Further, the projection piece 642 is provided to be tilted toward the first short side 641D.

Here, the projection piece 642 includes a base portion which is formed in a trapezoidal shape and is supported by the fixing portion 641, and a front end portion 642B which is formed in a rectangular shape, is positioned at a front end portion of the projection piece 642, and is extended from the base portion 642A. Here, the base unit 642A in the trapezoidal shape is formed to have a wider width as it goes from the side where the front end portion 642B is provided toward the side where the fixing portion 641 is provided.

Further, in this embodiment, a projection 643 that projects from the first long side 641B of the fixing portion 641 is provided. Here, the projection 643 is provided on the opposite side to the region where the projection piece 642 is provided across the fixing portion 641. Further, a plurality (in this embodiment, two) of projections 643 are provided, and are arranged to be tilted in the length direction of the fixing portion 641. Further, a circular through-hole 643A is formed on each projection 643.

Here, as shown in FIG. 4, the second sheet member 640 is provided to overlap on the first sheet member 620. More specifically, the projection piece 642 is provided to overlap the facing flexible piece 629F of the first sheet member 620.

Here, in this embodiment, as shown in FIG. 4, the dimensions in the width direction of the second sheet member 640 (direction that is orthogonal to the shaft direction of the rotating shaft 610 (see FIG. 3)) have become dimensions L5. Further, the dimensions in the width direction of the first sheet member 620 in a region where the facing flexible piece 629F is provided have become dimensions L6 that is larger than the dimensions L5. Further, the dimensions of the two flexible pieces 629 that neighbor both sides of the facing flexible piece 629F (hereinafter may be called "adjacent flexible pieces 629") have become dimensions L7 that is larger than the dimensions L5.

As a result, in this embodiment, as shown in FIG. 4, the short side EG2 of the free end side of the projection piece 642 is positioned on the side of the rotating shaft 610 (see FIG. 3) than the short side EG1 of the free end side of the facing flexible piece 629F. Further, in the same manner, the short side EG2 of the free end side of the projection piece 642 is positioned on the side of the rotating shaft 610 than the short side EG3 of the free end side of two adjacent flexible pieces 629 that are adjacent to the facing flexible piece 629F.

Further in this embodiment, as shown in FIG. 4, the width (width in the shaft direction of the rotating shaft 610 (see FIG. 3)) in the front end portion of the facing flexible piece 629F has become a width W1. Further, in this embodiment, the width of the toner discharge port 405A has become a width W2 that is larger than the width W1. Because of this, in this embodiment, the front end portion of the facing flexible piece 629F comes in the inside of the toner discharge port 405A when the front end portion passes through the toner discharge port 405A. Further, in this embodiment, as shown in the drawing, the width of the front end portion of the projection piece 642 (width of two angle portions KG) has become a width W3 that is larger than the width W2 of the toner discharge port 405A. Because of this, in this embodiment, the front end portion of the projection piece 642 does not come in the inside of the toner discharge port 405A when the front end portion passes through the toner discharge port 405A.

Further, in this embodiment, as shown in the drawing, the two angle portions KG provided on the front end portion of the projection piece 642 overlap the adjacent flexible pieces 629. Specifically, one of the two angle portions KG overlaps one of the two adjacent flexible pieces 629, and the other of the two angle portions KG overlaps the other of the two adjacent flexible pieces 629. In other words, in this embodiment, as shown in FIG. 4, the projection piece 642 is basically located on the inner side than the two neighboring slits 627 positioned on both sides of the facing flexible pieces 629F, but is located on the outer side than the slits 627 with respect to the two angle portions KG.

Then, a sheet member 720 provided on the second transport member 700 will be described.

Figure 8:
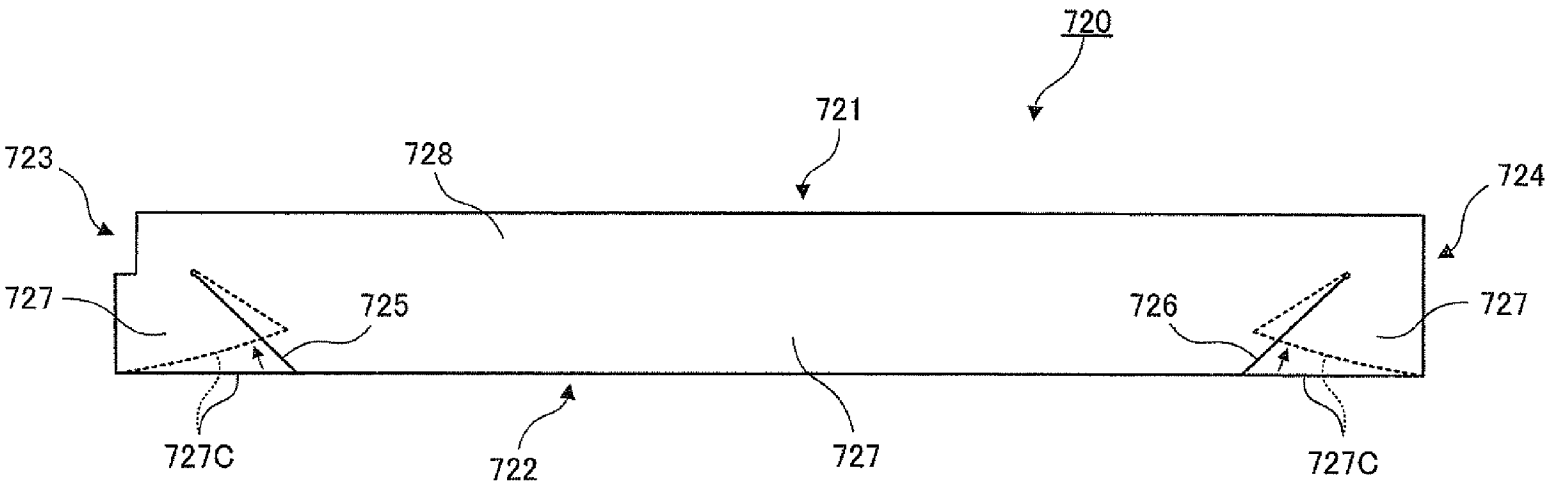
FIG. 8 is a view illustrating a sheet member provided on a second transport member.

FIG. 8 is a view illustrating the sheet member 720 provided on the second transport member.

Here, the sheet member 720 provided on the second transport member 700 is formed of a resin material, and has flexibility (elasticity) in the same manner as the above-described first sheet member 620. Further, the sheet member 720 is in a thin plate shape. Further, the sheet member 720 is in a rectangular shape, and has first to fourth side cut portions 721 to 724 provided on the circumference of the sheet member 720.

Here, in the same manner as the first sheet member 620, the sheet member 720 is arranged so that the first and second side cut portions 721 and 722 go along the length direction of the toner accommodation portion 400. Further, the sheet member 720 is arranged so that the third side cut portion 723 is positioned on the side of the first side wall 401 (see FIG. 3) of the toner accommodation portion 400 and the fourth side end portion 724 is positioned on the side of the second side wall 402 of the toner accommodation portion 400. Further, in the same manner as the first sheet member 620, the sheet member 720 has the first side end portion 721 that is fixed to the rotating shaft 710 (see FIG. 3).

Here, the sheet member 720 has two slits of a first slit 725 and a second slit 726. Here, the first slit 725 is one end portion in the length direction of the sheet member 720, and is provided at an end portion that is positioned on the side of the third side cut portion 723. Further, the second slit 726 is the other end portion in the length direction of the sheet member 720, and is provided at the end portion that is positioned on the side of the fourth side cut portion 724.

Further, in this embodiment, by providing the first slit 725 and the second slit 726, three bent pieces 727 and a base portion 728 supporting the three bent pieces 727 are provided. On the other hand, the first slit 725 is directed from the side of the second side cut portion 722 to the side of the first side cut portion 721 to approach the third side cut portion 723. Further, the second slit 726 is directed from the side of the second side cut portion 722 to the side of the first side cut portion 721 to approach the fourth side cut portion 724.

Here, the transport of the toner by the second transport member 700 is performed in a manner that the sheet member 720 pushes out the toner toward the first transport member 600. More specifically, by moving the sheet member 720 from the inside of the sheet surface in FIG. 8 to the front side, the toner on the bottom plate 405 (see FIG. 3) is pushed out toward the first transport member 600, and thus the toner is supplied to the first transport member 600.

On the other hand, two bent pieces positioned at both ends in the drawing, of three bent pieces 727 move the toner that is positioned on the corner of the toner accommodation portion 400 to the side of the center portion of the toner accommodation portion 400 in the length direction of the toner accommodation portion 400. Specifically, as described above, the front edges 727C of the two bent pieces 727 are slanted with respect to the length direction of the toner accommodation portion 400 as shown as a dotted line in the drawing, and through this slanting, the toner that is positioned on the corner of the toner accommodation portion 400 is moved to the side of the center portion of the toner accommodation portion 400.

Figure 9A:
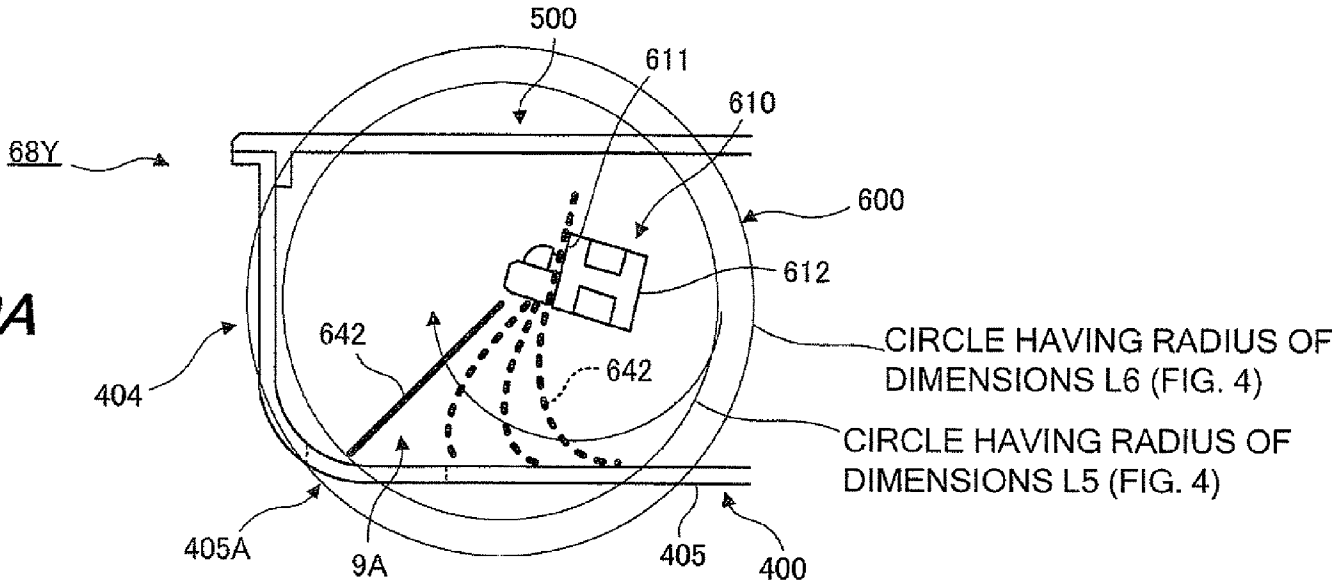
FIGS. 9A and 9B are views explaining the movement of a projection piece and a facing flexible piece.
Figure 9B:
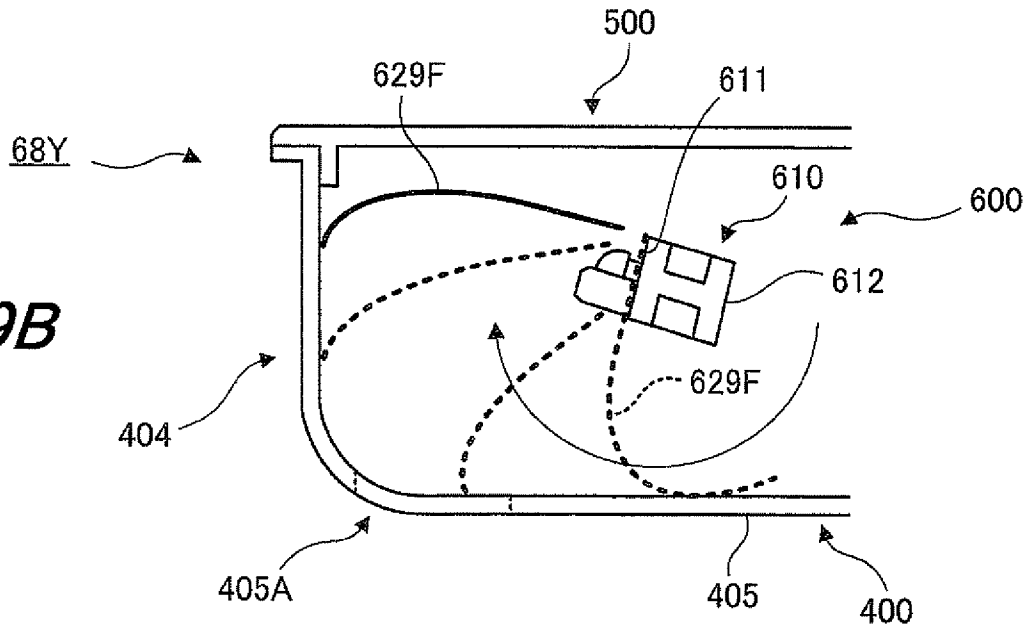

FIGS. 9A and 9B are views explaining the movement of the projection piece 642 and the facing flexible piece 629F. In other words, FIGS. 9A and 9B are views illustrating the movement of the projection piece 642 and the facing flexible piece 629F on the cross section taken along arrow line IX-IX in FIG. 3. FIG. 9A is a view illustrating the movement of the projection piece 642, and FIG. 9B is a view illustrating the movement of the facing flexible piece 629F.

In the case where the toner is transported in a toner cartridge 68Y, as shown in FIG. 9A, the rotating shaft 610 of the first transport member 600 is rotated clockwise in the drawing. Here, if the rotating shaft 610 is rotated clockwise, as shown in the drawings (A) and (B), the projection piece 642 and the facing flexible piece 629F are rotated about a portion that is fixed to the rotating shaft 610. Since the second sheet member 640 is positioned on the downstream side than the first sheet member 620 in the rotating direction of the first transport member 600, the second sheet member 640 faces the toner discharge port 405A to precede to the first sheet member 620.

In this embodiment, if the projection piece 642 becomes in contact with the bottom plate 405 of the toner accommodation portion 400, as shown in the drawing (A), the projection piece 642 bends to swell out toward the downstream side in the rotating direction of the rotating shaft 610. Further, the projection piece 642 is further rotated while maintaining the flexed state and moves toward the toner discharge piece 642. Here, the toner on the bottom plate 405 is pushed by the projection piece 642 and moves toward the toner discharge port 405A. Then, the front end portion of the projection piece 642 reaches the facing position of the toner discharge port 405A and slides along the upper surface of the toner discharge port 405A. Here, since the width W3 of the projection piece 642 is larger than the width W2 of the toner discharge port 405A, the front end portion of the projection piece 642 does not come in the toner discharge port 405A. Further, if the rotating shaft 610 is rotated, as shown as reference numeral 9A in the drawing, the front end portion of the projection piece 642 is positioned near a boundary between the fourth side wall 404 and the bottom plate 405 in the third region 404C, and the front end portion becomes in non-contact with the fourth side wall 404. Through this, the projection piece 642 is straightly extended by its own elasticity, and the front end portion of the projection piece 642 comes to jump up in the upper direction.

Here, in the toner cartridge 68Y according to this embodiment, a toner lump might occur in the inside of the toner cartridge 68Y due to the long-term safekeeping of the toner cartridge 68Y and vibration occurring during the transportation. In this case, it becomes difficult to discharge the toner.

In particular, if the toner is made up near the toner discharge port 405A, the toner discharge port 405A may be clogged to limit the discharge of the toner.

Because of this, in this embodiment, the second sheet member 640 that has higher rigidity than the first sheet member 620 (that is flexible and hard to break than the first sheet member 620) is made precede to the second sheet member 640 in the rotating direction of the first transport member 600 and face the toner discharge port 405A, and the toner lump is broken to make the toner discharged more smoothly. In this embodiment, since the front end of the projection piece 642 jumps up, the toner can be broken more easily, and smoother discharge of the toner from the toner discharge port 405A can be achieved.

Figure 7:
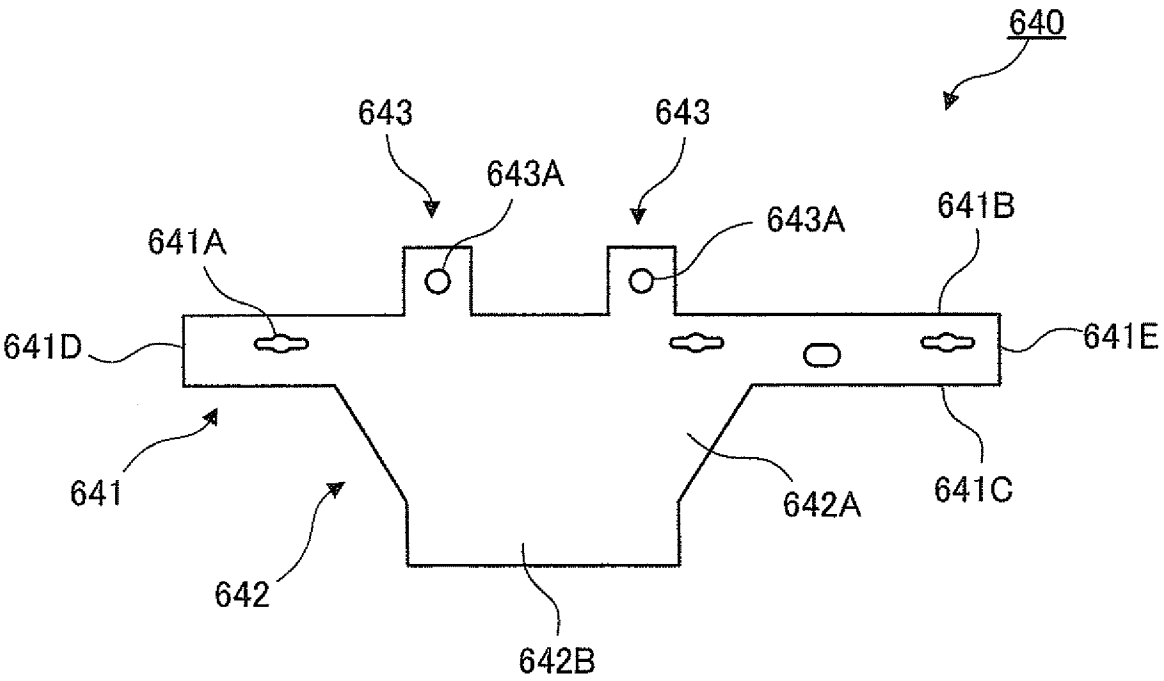
FIG. 7 is a view explaining a second sheet member.

In this embodiment, as shown in FIG. 7, the base portion 642A of the projection piece 642 is formed in a trapezoidal shape, and the width of the projection piece 642 becomes larger as the projection piece 642 goes from the front end side of the projection piece 642 and the base side of the projection piece 642. In this embodiment, the width of the base side of the projection piece 642 is larger than the width of the front end side of the projection piece 642. Here, for example, the width of the base portion 642A may not be large, but the width of the base portion 642A and the width of the front end portion 642B may be equal to each other. In this case, however, the rigidity of the projection piece 642 is lowered, and the power becomes small when the projection piece 642 makes the toner jump up. Because of this, in this embodiment, the width of the projection piece 642 becomes wider as the projection piece 642 goes from the front end side thereof to the base side.

Then, referring to FIG. 9B, the movement of the facing flexible piece 629F will be described.

Here, in the same manner as the projection piece 642, the facing flexible piece 629F bends to swell out toward the downstream side in the rotating direction of the rotating shaft 610. Further, the facing flexible piece is rotated while maintaining the flexed state. Through this, the toner on the bottom plate 405 is moved toward the toner discharge port 405A.

Further, since the width W1 of the facing flexible piece 629F is narrower than the width W2 of the toner discharge port 405A, the front end portion of the facing flexible piece 629F comes in the toner discharge port 405A. On the other hand, in this embodiment, the front end portion of the projection piece 642 is separated from the inner surface of the toner accommodation portion 400 as described above after the projection piece 642 passes through the toner discharge port 405A, whereas the facing flexible piece 629F is maintained in contact with the inner surface of the toner accommodation portion 400 after the facing flexible piece 629F passes through the toner discharge port 405A.

Although explanation has been omitted as above, as shown in FIGS. 9A and 9B, the rotating shaft 610 is formed to have a "H"-shaped cross section, and includes a first side surface 611 and a second side surface 612 positioned on the opposite side to the first side surface 611. On the other hand, the above-described projection 614 (see FIG. 3) is formed on the first side surface 611, and the first sheet member 620 and the second sheet member 640 are attached to comply with the first side surface 611. In other words, in this embodiment, the first sheet member 620 and the second sheet member 640 are attached to the same side surface among the plurality of side surfaces that the rotating shaft 610 has.

Figure 10:
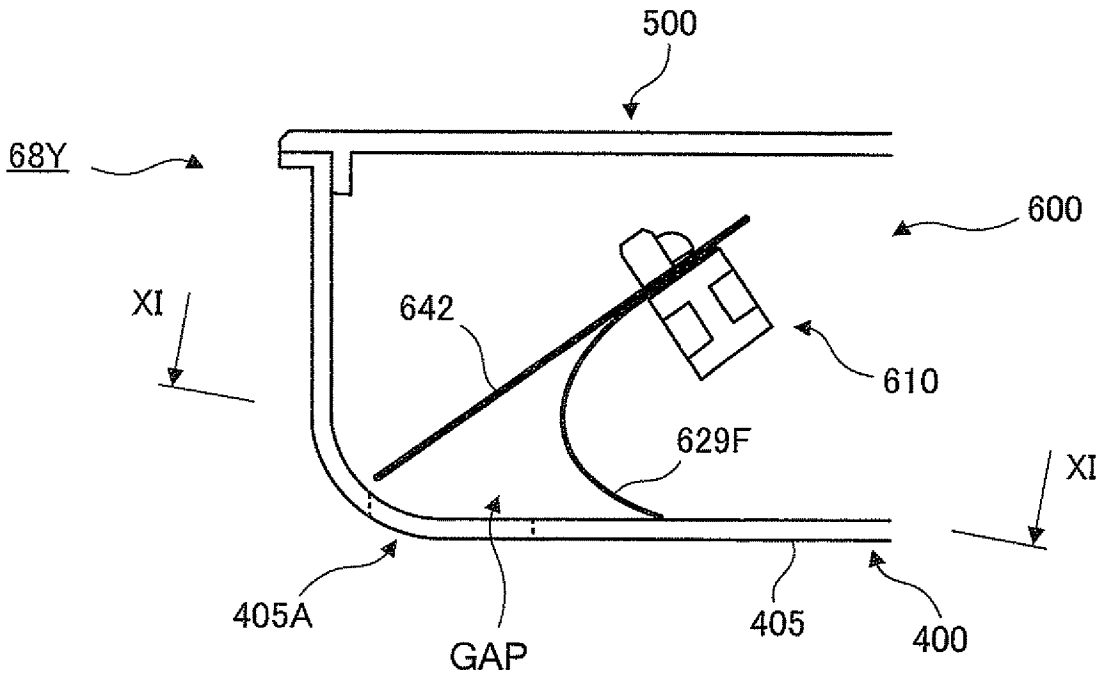
FIG. 10 is a view illustrating the state of a first transport member when a front end of a projection piece jumps up.

FIG. 10 is a view illustrating the state of the first transport member 600 when the front end of the projection piece 642 jumps up.

In this embodiment, in the rotating direction of the rotating shaft 610, the projection piece 642 is positioned on the downstream side than the facing flexible piece 629F. Because of this, if the front end of the projection piece 642 jumps up, as shown in FIG. 10, a gap is formed between the projection piece 642 and the facing flexible piece 629F. If such a gap is formed, the toner comes in the gap from the side of the gap (side in the shaft direction of the rotating shaft 610), and the toner in the gap is pressed by the facing flexible piece 629F and is moved up to the toner discharge port 405A.

In this embodiment, it is exemplified that the gap is formed between the projection piece 642 and the facing flexible piece 629F. However, the toner may be inserted between the projection piece 642 and the facing flexible piece 629F and a gap may be formed between the projection piece 642 and the facing flexible piece 629F. Under the circumstances, if the front end of the projection piece 642 jumps up, the gap between the projection piece 642 and the facing flexible piece 629F is widened.

Figure 11:
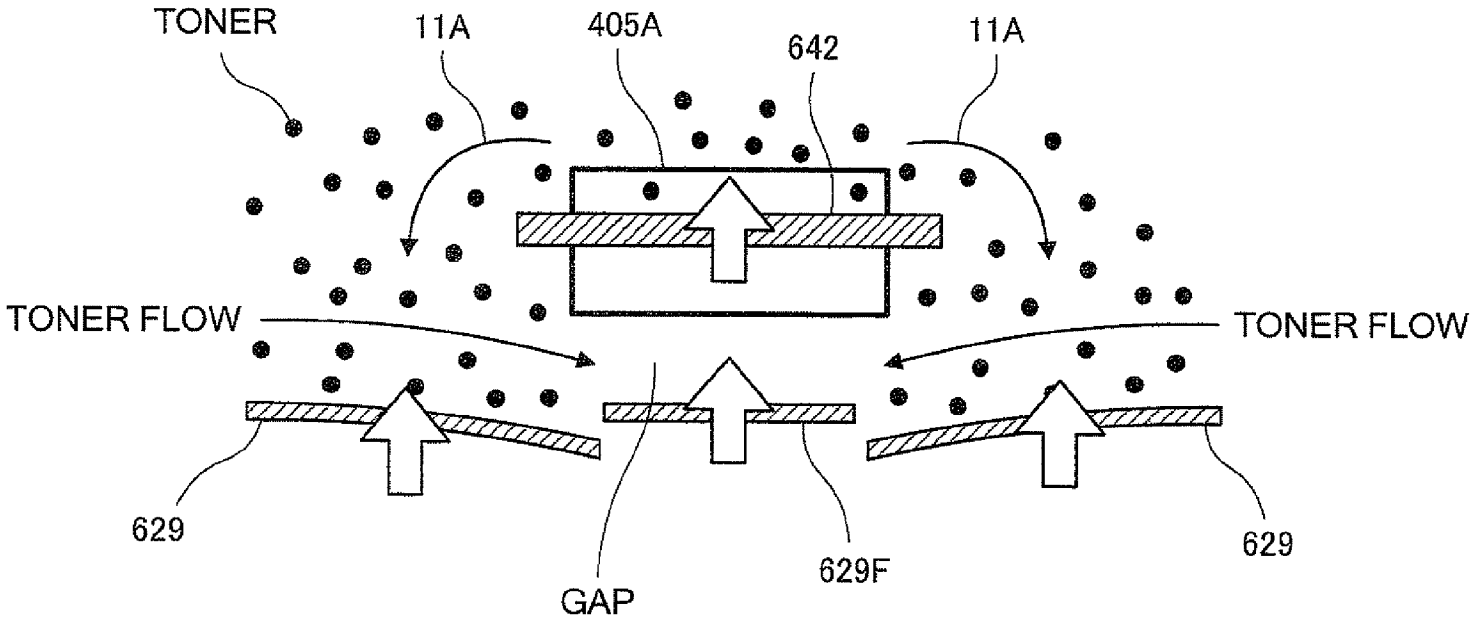
FIG. 11 is a cross-section view taken along line XI-XI in FIG. 10.

Referring to FIG. 11 (cross-sectional view taken along line XI-XI in FIG. 10), the movement of the projection piece 642 and the facing flexible piece 629F will be described in more detail.

If the front end of the projection piece 642 is separated from the facing flexible piece 629F, as shown in FIG. 11, a gap is formed between the projection piece 642 and the facing flexible piece F. In this embodiment, the toner comes in the gap from both sides of the gap, and the toner is pressed toward the toner discharge port 405A by the facing flexible piece 629F.

In this embodiment, as shown in FIG. 11, the adjacent flexible pieces 629 that are positioned on both sides of the facing flexible piece 629F are flexed so that one that is near to the toner discharge port 405A is positioned on the upstream side in the rotating direction of the rotating shaft 610 (not illustrated in FIG. 11), and the other that is separated from the toner discharge port 405A is positioned on the downstream side. Through this, as shown in the drawing, the toner that is positioned in the facing position of the adjacent flexible piece 629 is moved toward the side where the gap is positioned. Accordingly, the toner further comes in the gap.

In this embodiment, if the toner is pressed toward the movement direction of the projection piece 642 by the projection piece 642, as shown as an arrow 11A in the drawing, the toner comes to drop on the side of a path that the projection piece 642 is to move. Through this, the pulling down of the toner comes to be more accomplished. In this embodiment, as described above, the width of the projection piece 642 is larger than the width of the toner discharge port 405A. Through this, in comparison to a case where the width of the projection piece 642 is smaller than the width of the toner discharge port 405A, the preceding projection piece 642 can move the toner of a wider range from all around the toner discharge port 405A, and thus a space in which the toner comes in the gap is increased. Further, the toner lump becomes hard to exist around the toner discharge port 405A, and the discharge of the toner from the toner discharge port 405A can be performed more smoothly. The facing flexible piece 629F comes in the toner discharge port 405A to drop the powder that exists in the toner discharge port 405A.

Figure 12:
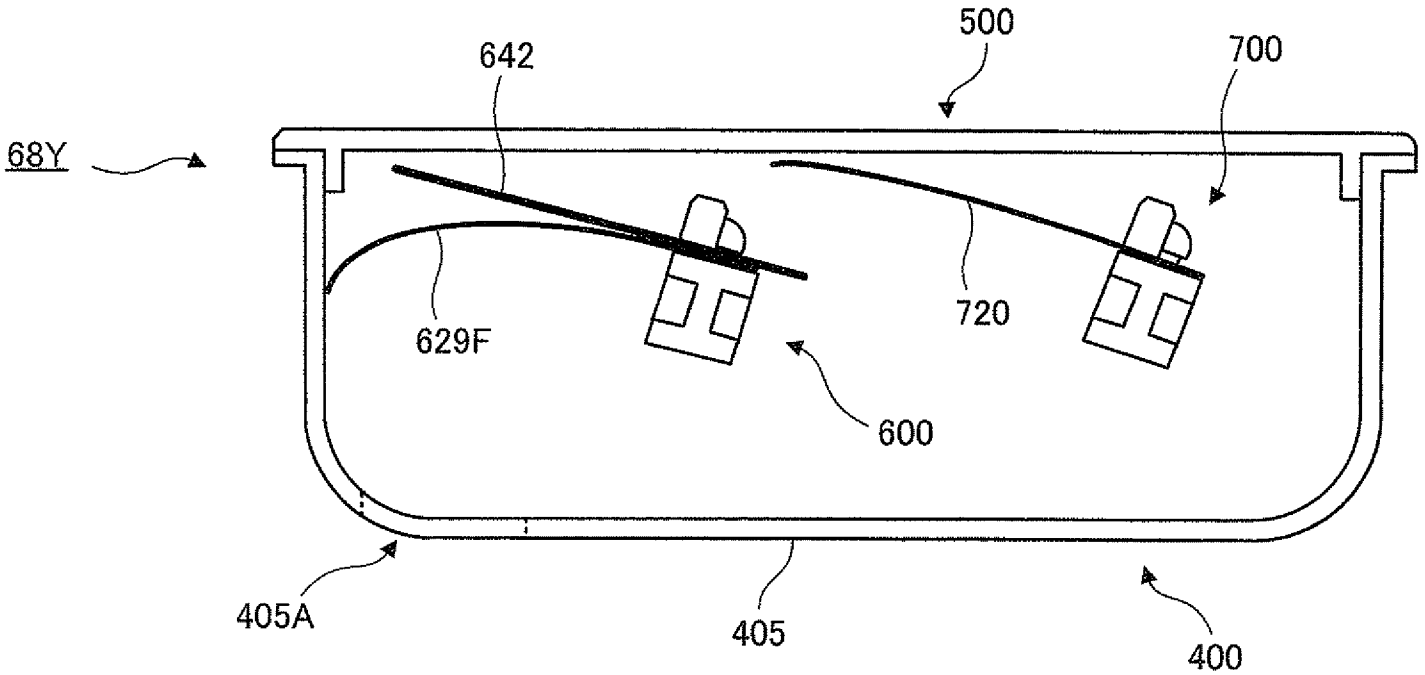
FIG. 12 is a view illustrating the internal state of a toner cartridge according to an embodiment when the toner cartridge is shipped.

FIG. 12 is a view illustrating the internal state of the toner cartridge 68Y according to an embodiment when the toner cartridge 68Y is shipped.

In this embodiment, during manufacturing of the toner cartridge 68Y, the first gear 81 shown in FIG. 3 is rotated by a manufacturer or a manufacturing device, and the projection piece 642 is arranged toward a predetermined direction. Specifically, as shown in FIG. 12, the projection piece 642 is arranged so that the front end portion of the projection piece 642 is positioned on a corner portion of the toner cartridge 68Y. In more detail, the projection piece 642 is arranged so that the front end portion of the projection piece 642 becomes in non-contact with the inner surface of the toner cartridge 68Y. Here, if the projection piece 642 is arranged so that the front end portion of the projection piece 642 becomes in non-contact with the inner surface of the toner cartridge 68Y as in this embodiment, the transformation of the projection piece 642 is suppressed.

Figure 13:
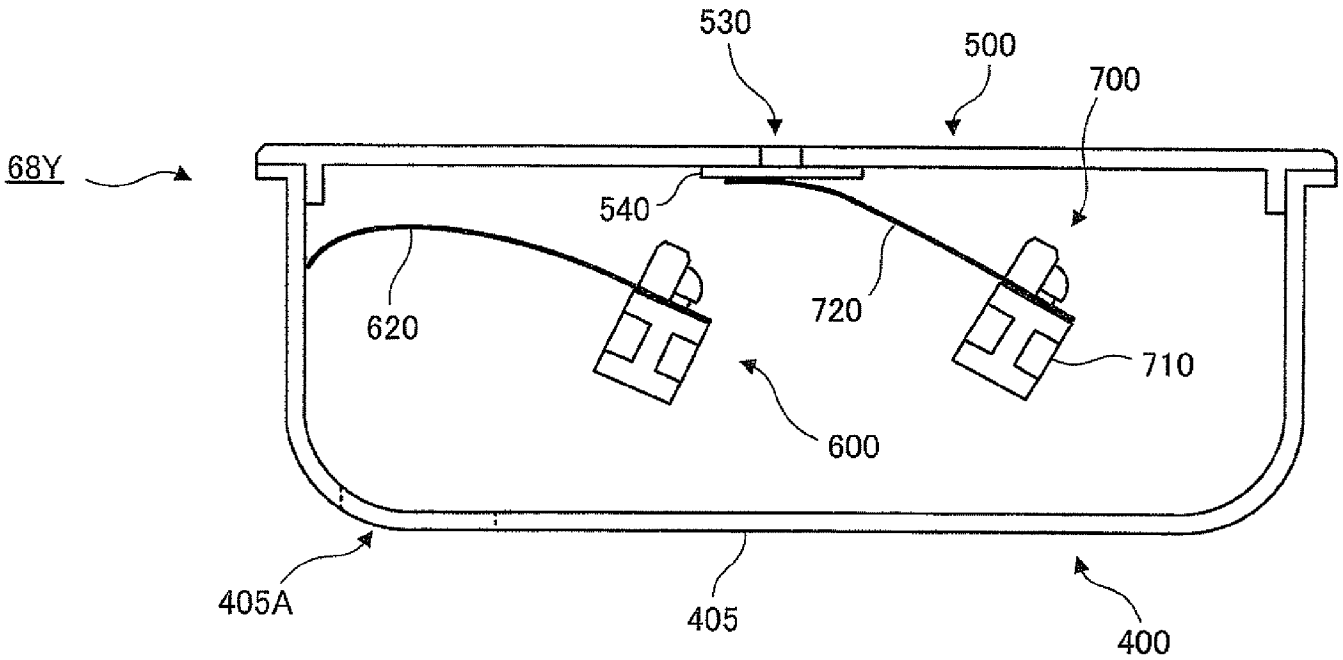
FIG. 13 is a view illustrating the internal state of a toner cartridge, which differs from FIG. 12, when the toner cartridge is shipped.

FIG. 13 is a view illustrating the internal state of a toner cartridge, which differs from the state as shown in FIG. 12, when the toner cartridge is shipped. Referring to FIGS. 12 and 13, the rotation angles (phases) of the first transport member 620 and the second transport member 720 are the same. Specifically, the rotation angles correspond to the state taken along line XIII-XIII in FIG. 2.

In this embodiment, as described above, during manufacturing of the toner cartridge 68Y, the first gear 81 is rotated, and the projection piece 642 is arranged so that the front end portion of the projection piece 642 is positioned toward the corner portion of the toner cartridge 68Y. Further, in this embodiment, the second transport member 700 is also rotated, and the shipment of the toner cartridge 68Y is carried out after the second transport member 700 is in a predetermined state. Specifically, as shown in FIG. 13, the shipment of the toner cartridge 68Y is carried out in a state where the sheet member 720 faces the facing position of a through-hole 530 and a filter 540.

In this embodiment, the first transport member 600 and the second transport member 700 interlock with each other, and if the first gear 81 is rotated, the second transport member 700 is also rotated. Further, in this embodiment, if the first gear 81 is rotated so that the front end portion of the projection piece 642 faces the corner portion side of the toner cartridge 68Y, the sheet member 720 is positioned in the facing position of the through-hole 530 and the filter 540. As a result, in this embodiment, the manufacturing process is simplified in comparison to the case where the first transport member 600 and the second transport member 700 are separately rotated to perform positioning of the projection piece 642 and the positioning of the sheet member 720.

Here, the toner cartridge 68Y is conveyed to a customer with various postures. Further, during the conveyance of the toner cartridge 68Y, vibration is applied to the toner cartridge 68Y. As a result, the toner may be attached to the filter 540 to get into the inside of the filter 540 and block up the filter 540. Because of this, in this embodiment, as described above, the toner cartridge 68Y is shipped in a state where the sheet member 720 faces the filter 540. Through this, the toner is prevented from being attached to the filter 540 and getting into the inside of the filter 540, and the blocking of the filter 540 becomes hard to occur. Further the projection piece 642 is in non-contact state to the inner face of the toner container 400 in a state where the sheet member 720 faces the filter 540. Therefore, the deformation of the projection piece 642 is suppressed by shipping the toner cartridge 68Y in the state.

Figure 14:
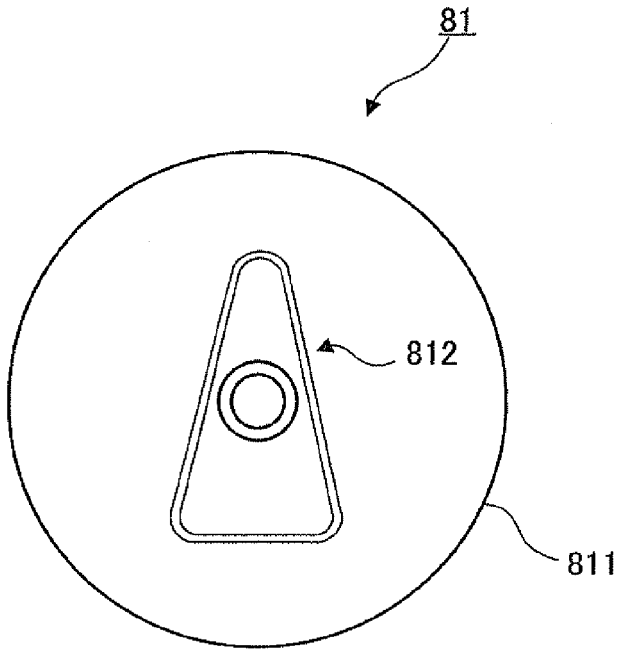
FIG. 14 is a view of a first gear as seen in the direction of an arrow XIV in FIG. 3.

FIG. 14 is a view of a first gear 81 as seen in the direction of an arrow XIV in FIG. 3.

The first gear 81 is formed in a disk shape, and as shown in FIG. 14, has a circumferential surface 811. On the other hand, a tooth portion (not illustrated) is provided on the circumferential surface 811, and this tooth portion is tooth-engaged with a tooth portion of a gear provided on the side of the apparatus body 10A to transmit the driving force to the first gear 81. Further, in this embodiment, for the side surface of the first gear 81, as shown in FIG. 14, a mark 812 that is in the form of an isosceles triangle having two long sides and one short side is formed. On the other hand, this mark 812 is formed by a groove formed on the side surface of the first gear 81.

In this embodiment, as described above, during the manufacturing of the toner cartridge 68Y, the first gear 81 is rotated by a manufacturer or a manufacturing device, and the positioning of the projection piece 642 is performed. Here, in this embodiment, although the positioning is performed as described above, the positioning is performed using the mark 812 at this time. More specifically, the positioning is performed by rotating the first gear 81 so that the acute-angled vertex, which is formed on the region where the two long sides cross each other, is directed to the predetermined direction. On the other hand, in the case of manufacturing the toner cartridge 68Y using the manufacturing device, the positioning is performed by reading the mark 812 through a sensor or the like and rotating the first gear 81. Further, by inspection after the manufacturing, if it is found that the first gear 1 is not in the authorized position, the first gear 81 is rotated to the authorized position.

Figure 15:
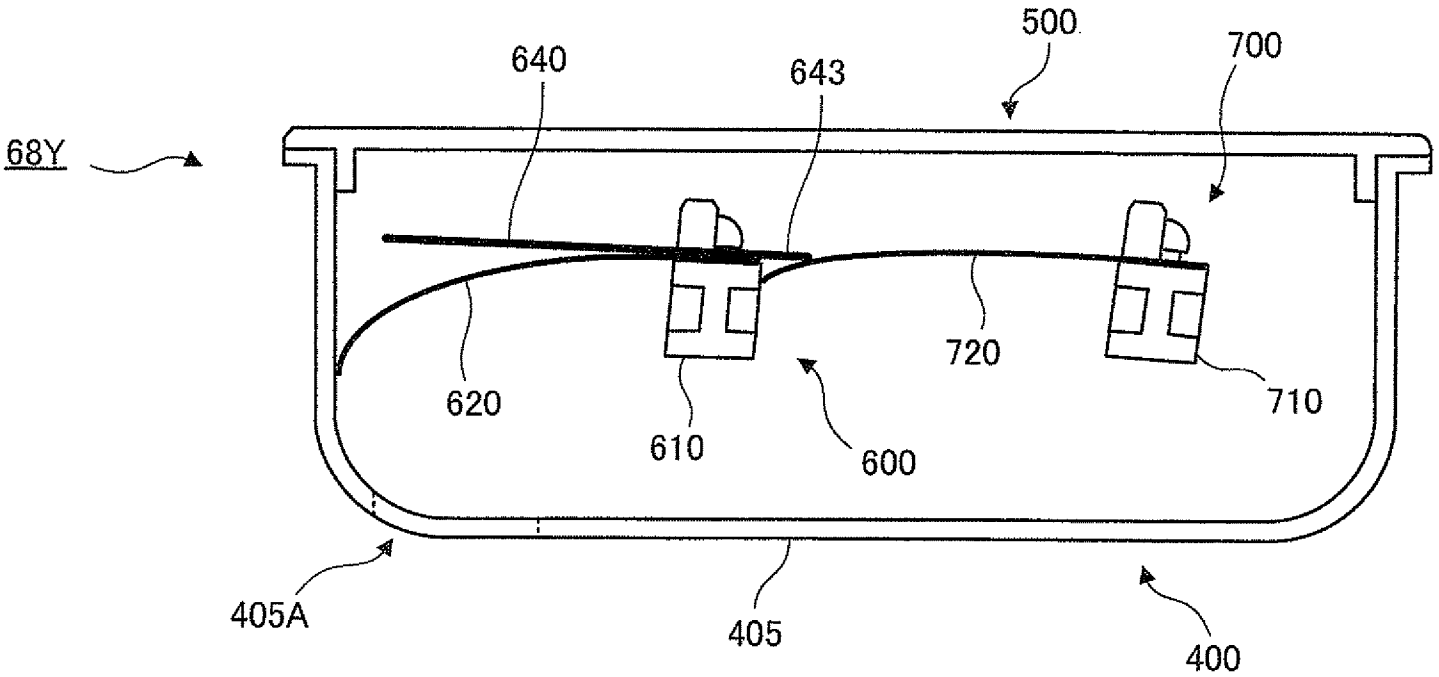
FIG. 15 is a view illustrating another state of the inside of the toner cartridge.
Figure 16:
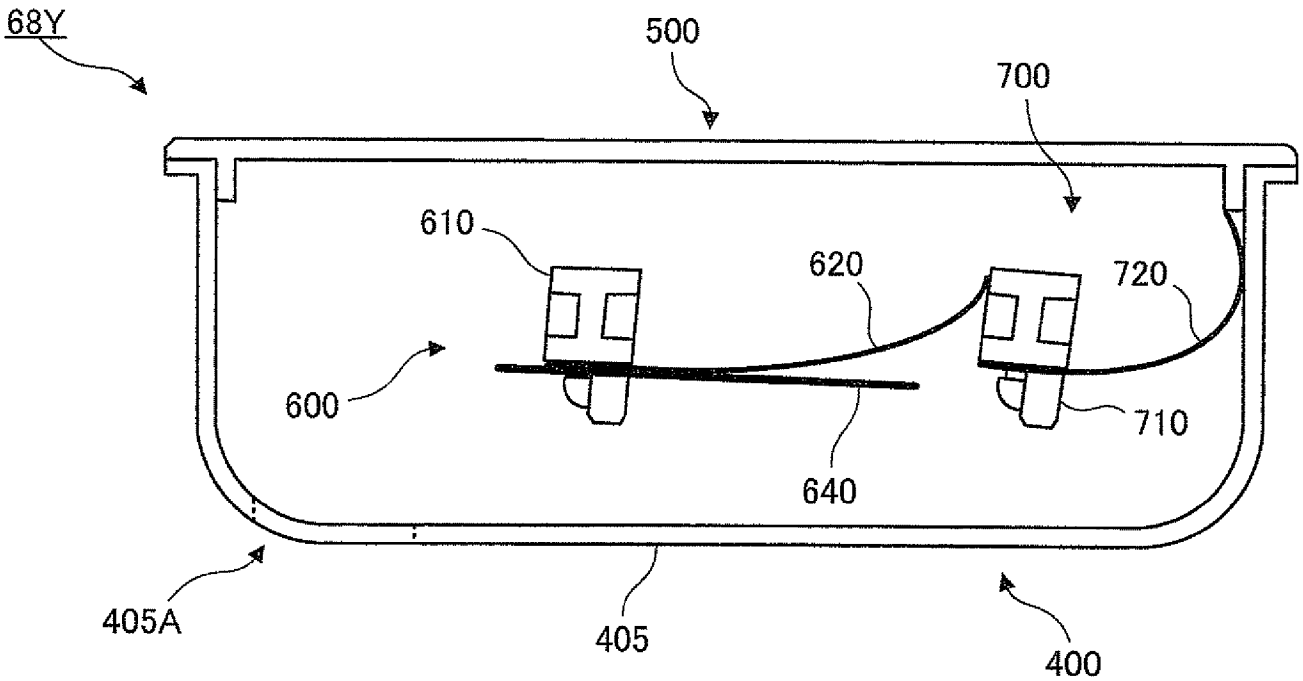
FIG. 16 is a view illustrating still another state of the inside of the toner cartridge.

FIGS. 15 and 16 are views illustrating other states of the inside of the toner cartridge 68Y. FIGS. 15 and 16 show the states taken along line XV-XV in FIG. 2. In the toner cartridge according to this embodiment, as shown in FIG. 15, the sheet member 720 of the second transport member 700 becomes in contact with the rotating shaft 610 of the first transport member 600. Further, as shown in FIG. 16, the first sheet member 620 of the first transport member 600 becomes in contact with the rotating shaft 710 of the second transport member 700.

Here, if the sheet member that is provided on one side transport member becomes in contact with the rotating shaft that is provided on the other transport member, the toner attached to the rotating shaft is scratched by the sheet member and thus is easily taken off. Further, the toner is prevented from being attached to the sheet member, and even the toner that is attached to the sheet member becomes easy to drop downward. In this embodiment, both the first sheet member 620 that is provided on the first transport member 600 and the sheet member 720 that is provided on the second transport member 700 become in contact with the rotating shaft. However, only one side sheet member may be in contact with the rotating shaft.

In this embodiment, as shown in FIG. 15, the sheet member of the second transport member 700 becomes in contact with the projection 643 provided on the second sheet member 640. Here, if the sheet member 720 is in contact with the projection 643, in comparison to the configuration in which the projection 643 is not provided, the toner can be prevented from being attached to the second sheet member 640, and much more toner can be removed from the sheet member 720 and the second sheet member 640.

In this embodiment, the facing flexible piece 629F is formed as a part of the first transport member 620 by providing the slit on the first transport member 620. However, the facing flexible piece 629F may be provided separately from the first transport member 620. In this case, the facing flexible piece 629F and the second sheet member 640 may be provided with the phase shift with respect to the rotating shaft 610, for example, on the opposite side.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A powder accommodation container comprising:

an accommodation container body that accommodates powder;

a transport member that is arranged in an inside of the accommodation container body, rotates about a rotating shaft, and transports powder in the inside of the accommodation container body; and a discharge port that is provided on the accommodation container body and discharges the powder accommodated in the accommodation container body to an outside of the accommodation container body, wherein the transport member at a position corresponding to the discharge port includes a first transport piece transporting the powder toward the discharge port, and a second transport piece arranged on a downstream side in a rotating direction of the rotating shaft than the first transport piece, the second transport piece has a length that is in non-contact with the inner surface at an immediate downstream of the discharge port in the rotating direction, and the first transport piece becomes in contact with the inner surface at an immediate upstream of the discharge port in the rotating direction in a state where the second transport piece is in non-contact with the inner surface at the immediate downstream of the discharge port in the rotating direction, wherein a width of the second transport piece in an axial direction of the rotating shaft is larger than a width of the discharge port in the axial direction.

2. The powder accommodation container according to claim 1, wherein the second transport piece has the length that is in contact with an inner surface of the accommodation container body at the immediate upstream of the discharge port in the rotating direction.

3. The powder accommodation container according to claim 1, wherein the width of the discharge port in the axial direction is larger than a width of the first transport piece in the axial direction, and the first transport piece is enterable in an inside of the discharge port.

4. The powder accommodation container according to claim 1, wherein one end side of the second transport piece is fixed to the rotating shaft and the other side of the second transport piece is a free end, and a width of the free end side in the rotating direction is smaller than a width of the one end side in the axial direction.

5. The powder accommodation container according to claim 1, wherein the first transport piece is provided in a first transport member of which one end side is fixed to the rotating shaft and the other end side is a free end that is in contact with the inner surface of the accommodation container body, and the first transport member and the second transport piece use a fixing portion provided on the rotating shaft in common.

6. The powder accommodation container according to claim 1, wherein the accommodation container body includes a second transport member which is rotated around a second rotating shaft to transport the powder in the inside of the accommodation container body toward the transport member, and the first transport piece is contactable with the second rotating shaft.

7. The powder accommodation container according to claim 1, wherein the accommodation container body includes a second transport member which is rotated around a second rotating shaft to transport the powder in the inside of the accommodation container body toward the transport member, and the second transport member has one end side which is fixed to the rotating shaft and the other end side which is a free end that is contactable with the second transport piece.

8. The powder accommodation container according to claim 1, wherein the accommodation container body includes:

a hole formed to penetrate the inside and an outside of the accommodation container body; and a regulation member provided in the hole to regulate a passage of the powder through the hole, wherein when the second transport member faces the hole, the second transport piece becomes in non-contact with the inner surface of the accommodation container body.

9. An image forming apparatus to which the powder accommodation container according to claim 1 is detachable, wherein the image forming apparatus forms an image using powder accommodated in the powder accommodation container.

10. A powder accommodation container comprising:

an accommodation container body that accommodates powder;

a transport member that is arranged in an inside of the accommodation container body, rotates about a rotating shaft, and transports powder in the inside of the accommodation container body; and a discharge port that is provided on the accommodation container body and discharge the powder accommodated in the accommodation container body to an outside, wherein the transport member includes a first transport piece transporting the powder toward the discharge port at a position corresponds to the discharge port; and a second transport piece arranged at the same side as the first transport piece with respect to the rotating shaft and on a downstream side of the first transport piece in a rotating direction of the rotating shaft, wherein the second transport piece passes through the position that corresponds to the discharge port prior to the first transport piece by rotation of the rotating shaft while a gap is formed between the first transport piece and the second transport piece in the rotating direction, and wherein a width of the second transport piece in an axial direction of the rotating shaft is larger than a width of the discharge port in the axial direction.

11. The powder accommodation container according to claim 10, wherein the width of the discharge port in the axial direction is larger than a width of the first transport piece in the axial direction, and the first transport piece is enterable in an inside of the discharge port.

12. The powder accommodation container according to claim 10, wherein one end side of the second transport piece is fixed to the rotating shaft and the other side of the second transport piece is a free end, and a width of the free end side in the rotating direction is smaller than a width of the one end side in the axial direction.

13. The powder accommodation container according to claim 10, wherein the first transport piece is provided in a first transport member of which one end side is fixed to the rotating shaft and the other end side is a free end that is in contact with an inner surface of the accommodation container body, and the first transport member and the second transport piece use a fixing portion provided on the rotating shaft in common.

14. The powder accommodation container according to claim 10, wherein the accommodation container body includes a second transport member which is rotated around a second rotating shaft to transport the powder in the inside of the accommodation container body toward the transport member, and the first transport piece is contactable with the second rotating shaft.

15. The powder accommodation container according to claim 10, wherein the accommodation container body includes a second transport member which is rotated around a second rotating shaft to transport the powder in the inside of the accommodation container body toward the transport member, and the second transport member has one end side which is fixed to the rotating shaft and the other end side which is a free end that is contactable with the second transport piece.

16. The powder accommodation container according to claim 14, wherein the accommodation container body includes:

a hole formed to penetrate the inside and an outside of the accommodation container body; and a regulation member provided in the hole to regulate a passage of the powder through the hole, wherein when the second transport member faces the hole, the second transport piece becomes in non-contact with an inner surface of the accommodation container body.

17. The powder accommodation container according to claim 10, wherein the rotating shaft of the transport member is connected to a gear which is provided on an outer surface of the accommodating container body and configured to receive a driving force from the gear, and a mark is formed on the outer surface of the accommodating container body for positioning the second transport piece at a position where the free end of the second transport piece becomes in non-contact with an inner surface of the accommodation container body.

18. A powder accommodation container comprising:

an accommodation container body that accommodates powder;

a transport member that is arranged in an inside of the accommodation container body, rotates about a rotating shaft, and transports powder in the inside of the accommodation container body; and a discharge port that is provided on the accommodation container body and discharges the powder accommodated in the accommodation container body to an outside of the accommodation container body, wherein:

the transport member at a position corresponding to the discharge port includes a first transport piece transporting the powder toward the discharge port, and a second transport piece arranged on a downstream side of the first transport piece in a rotating direction of the rotating shaft, the second transport piece has a length that is in contact with an inner surface of the accommodation container body at an immediate upstream of the discharge port in the rotating direction and in non-contact with the inner surface at an immediate downstream of the discharge port in the rotating direction, the first transport piece has a length that is in contact with the inner surface at the immediate upstream of the discharge port in the rotating direction in a state where the second transport piece is in non-contact with the inner surface at the immediate downstream of the discharge port in the rotating direction, and the rotating shaft of the transport member is connected to a gear which is provided on an outer surface of the accommodating container body and configured to receive a driving force from the gear, and a mark is formed on the outer surface of the accommodating container body for positioning the second transport piece at a position where the free end of the second transport piece becomes in non-contact with the inner surface of the accommodation container body.

* * * * *